US008193936B2

(12) United States Patent
Houston

(10) Patent No.: US 8,193,936 B2
(45) Date of Patent: Jun. 5, 2012

(54) SOLAR POWERED SECURITY SYSTEM

(75) Inventor: Robert Houston, Homestead, FL (US)

(73) Assignee: Solarbeam Security, LLC, Homestead, FL (US)

( * ) Notice: Subject to any disclaimer, the term of this patent is extended or adjusted under 35 U.S.C. 154(b) by 0 days.

(21) Appl. No.: 12/634,346

(22) Filed: Dec. 9, 2009

(65) Prior Publication Data

US 2010/0194565 A1 Aug. 5, 2010

Related U.S. Application Data

(63) Continuation of application No. 11/894,267, filed on Aug. 20, 2007, now abandoned, which is a continuation of application No. PCT/US2006/037306, filed on Sep. 25, 2006, which is a continuation-in-part of application No. 10/933,595, filed on Sep. 3, 2004, now Pat. No. 7,301,457, which is a continuation-in-part of application No. 09/956,558, filed on Sep. 20, 2001, now Pat. No. 6,801,128.

(60) Provisional application No. 60/234,227, filed on Sep. 21, 2000, provisional application No. 60/234,310, filed on Sep. 21, 2000.

(51) Int. Cl.
*G08B 13/18* (2006.01)

(52) U.S. Cl. ..... 340/556; 340/557; 340/541; 340/693.5; 340/539.16; 340/539.17; 361/600

(58) Field of Classification Search ..... 340/541–545.1, 340/555–557, 539.16, 539.17, 567, 693.5; 361/600–601; 248/121, 346.01, 637
See application file for complete search history.

(56) References Cited

U.S. PATENT DOCUMENTS

| | | | | | |
|---|---|---|---|---|---|
| 3,623,057 | A | * | 11/1971 | Hedin et al. | 340/557 |
| 3,688,298 | A | * | 8/1972 | Miller et al. | 340/557 |
| 3,803,548 | A | | 4/1974 | Skujins, Jr. | |
| 4,186,388 | A | | 1/1980 | Robinson | |
| 4,191,953 | A | | 3/1980 | Woode | |
| 4,322,007 | A | | 3/1982 | Feibelman | |
| 4,328,487 | A | * | 5/1982 | Cheal | 340/554 |
| 4,479,113 | A | | 10/1984 | McNeilly et al. | |
| 4,691,892 | A | | 9/1987 | Grewe et al. | |
| 4,823,772 | A | | 4/1989 | Lenz | |
| 4,910,498 | A | | 3/1990 | Feher | |
| 4,961,506 | A | | 10/1990 | Lang | |
| 4,978,942 | A | | 12/1990 | Bruce | |
| 5,049,858 | A | | 9/1991 | Price | |
| 5,167,436 | A | | 12/1992 | Wu | |
| 5,198,799 | A | | 3/1993 | Pascale | |
| 5,422,638 | A | | 6/1995 | Singer et al. | |
| 5,440,292 | A | | 8/1995 | Bedrosian | |
| 5,446,446 | A | | 8/1995 | Harman | |
| 5,450,063 | A | | 9/1995 | Peterson et al. | |
| 5,552,767 | A | | 9/1996 | Toman | |

(Continued)

FOREIGN PATENT DOCUMENTS

WO WO97/01160 A1 1/1997

(Continued)

*Primary Examiner* — Anh V La
(74) *Attorney, Agent, or Firm* — Krieg DeVault LLP

(57) ABSTRACT

A solar powered perimeter beam security system comprising a plurality of spaced towers. The towers have detection beams extending between them for detecting an intruder when at least one of the detection beams is interrupted. Each of the towers communicates with a remote unit.

21 Claims, 28 Drawing Sheets

U.S. PATENT DOCUMENTS

| | | | |
|---|---|---|---|
| 5,554,972 | A | 9/1996 | Byrne |
| 5,617,962 | A | 4/1997 | Chen |
| 5,622,078 | A | 4/1997 | Mattson |
| 5,820,086 | A | 10/1998 | Hoftman et al. |
| 5,848,707 | A | 12/1998 | Hill |
| 5,875,578 | A | 3/1999 | Grewe |
| 5,893,541 | A | 4/1999 | Michaelson |
| 5,915,656 | A | 6/1999 | Grewe |
| 5,939,987 | A | 8/1999 | Cram |
| 5,957,417 | A | 9/1999 | Yu |
| 6,004,002 | A | 12/1999 | Giannone |
| 6,007,032 | A | 12/1999 | Kuo |
| 6,061,245 | A | 5/2000 | Ingraham et al. |
| 6,114,963 | A | 9/2000 | Blake et al. |
| 6,118,375 | A | 9/2000 | Duncan |
| 6,127,926 | A | 10/2000 | Dando |
| 6,774,790 | B1 | 8/2004 | Houston |
| 6,801,128 | B1 | 10/2004 | Houston |
| 6,917,298 | B2 | 7/2005 | Romano et al. |
| 7,148,815 | B2 | 12/2006 | Derringer |
| 7,301,457 | B2 | 11/2007 | Houston |
| 2003/0154262 | A1 | 8/2003 | Kaiser et al. |
| 2004/0012491 | A1 | 1/2004 | Kulesz et al. |
| 2004/0015336 | A1 | 1/2004 | Kulesz et al. |
| 2007/0035394 | A1 | 2/2007 | Houston |
| 2008/0031213 | A1 | 2/2008 | Kaiser et al. |

FOREIGN PATENT DOCUMENTS

| | | |
|---|---|---|
| WO | WO01/26068 | 4/2001 |

* cited by examiner

POINT TO POINT SINGLE DUAL BEAM
MAXIMUM DISTANCE 660 FEET FROM TOWER TO TOWER

HIGH/LOW – MAXIMUM DISTANCE 660 FEET FROM TOWER TO TOWER

HIGHEST LEVEL - MAXIMUM DISTANCE OF 450 FEET FROM TOWER TO TOWER

SOLAR POWERED SECURITY SYSTEM

This application is a continuation of U.S. application Ser. No. 11/894,267, filed on Aug. 20, 2007, now abandoned which is a continuation of International Patent Application No. PCT/US06/37306, filed on Sep. 25, 2006, which is a continuation-in-part application of U.S. application Ser. No. 10/933,595 filed on Sep. 3, 2004, now U.S. Pat. No. 7,301,457 which is a continuation-in-part application of U.S. application Ser. No. 09/956,558 filed on Sep. 20, 2001, now U.S. Pat. No. 6,801,128, which claims the benefit of priority of U.S. Provisional Application No. 60/234,227 filed on Sep. 21, 2000 and U.S. Provisional Application No. 60/234,310 filed on Sep. 21, 2000, all of which are expressly incorporated by reference herein each in its entirety.

BACKGROUND OF THE INVENTION

The present invention relates to a perimeter monitoring techniques, and more particularly, but not exclusively relates to a solar powered perimeter security system for detecting intruders, among other things.

SUMMARY

One embodiment of the present invention is a unique solar-powered device. Other embodiments include unique methods, devices, and apparatus involving security systems and/or intruder monitoring towers. Among the applications of such devices is the utilization of a perimeter beam to detect intrusion.

In a further embodiment, the security system employs solar towers for detecting an intruder. The security system includes a receiver/processor communicating with electronic devices in the solar beam towers, the receiver/processor having an antenna, housing, and an indicator. A detection beam is used to detect intruders. The detection beam may be a photoelectric beam, an infrared beam, a laser beam, a microwave beam or a visible light beam, or a combination thereof.

In still another embodiment, the security system employs solar towers for detecting an intruder. The security system includes a receiver/processor communicating with electronic devices in the solar beam towers, the receiver/processor having an antenna, a housing and an indicator. The indicator includes information on the location of an intrusion.

Yet another embodiment includes a detection beam to detect intruders. The alarms sent out by the solar powered perimeter beam apparatus may include an audible alarm, a visible alarm, a telephone dialer, a printer or a recording device. In one form, a central unit exchanges information between the remote units via two way half-duplex radio device. As a radio data reporting system, the beam apparatus can report events and selectively transmit an alarm to the central unit when a new event is detected. In response, the central unit can display a change in status, and may include various indicators and other working components such as LEDs, pushbuttons, and one or more remote unit boards.

In one particular form a solar powered tower includes a 20 watt solar panel, a stainless steel solar panel mounting bracket, a swivel clamping bolt, a swivel bracket O-ring, a swivel solar bracket, a solar cap O-ring, a solar cap opening mechanism, a solar base cap, and a stainless steel top plate. The solar tower also includes frame support rods, a frame unit, a six inch frame tower, face shields, a battery clamp, a base unit, and face shield slots.

In a different embodiment, a security system employs multiple beam generators on a tower to generate multiple beams which extend to an adjacent tower. The security system includes a receiver/processor and transmitter for communicating with electronic devices between the perimeter beam towers and a remote processing data collection station or unit. Each tower typically houses a receiver/processor and transmitting device having an antenna, housing, and an indicator. The indicator can provide information about the detected location of an intrusion.

In one form, a solar panel according to this embodiment may be mounted to the perimeter beam tower to provide local power, eliminating the need to supply power from a remote source. When a solar panel is used, the solar panel is supported by a mounting bracket, a swivel clamping bolt, a swivel bracket O-ring, a swivel solar bracket, a solar cap O-ring, a solar cap opening mechanism, a solar base cap, and a stainless steel top plate. The perimeter beam tower also includes frame support rods, a frame unit, a frame tower, face shields, a base unit, and face shield slots.

One object of the present application is to provide a unique solar powered device. Another object of the present application is to provide a unique method, device, or apparatus involving a security system and/or intruder monitoring tower.

Other embodiments, forms, features, aspects, benefits, objects and advantages of the present invention will be more readily apparent from the following detailed description when read in conjunction with the accompanying drawings.

DETAILED DESCRIPTION OF REPRESENTATIVE EMBODIMENTS

Figure 1:
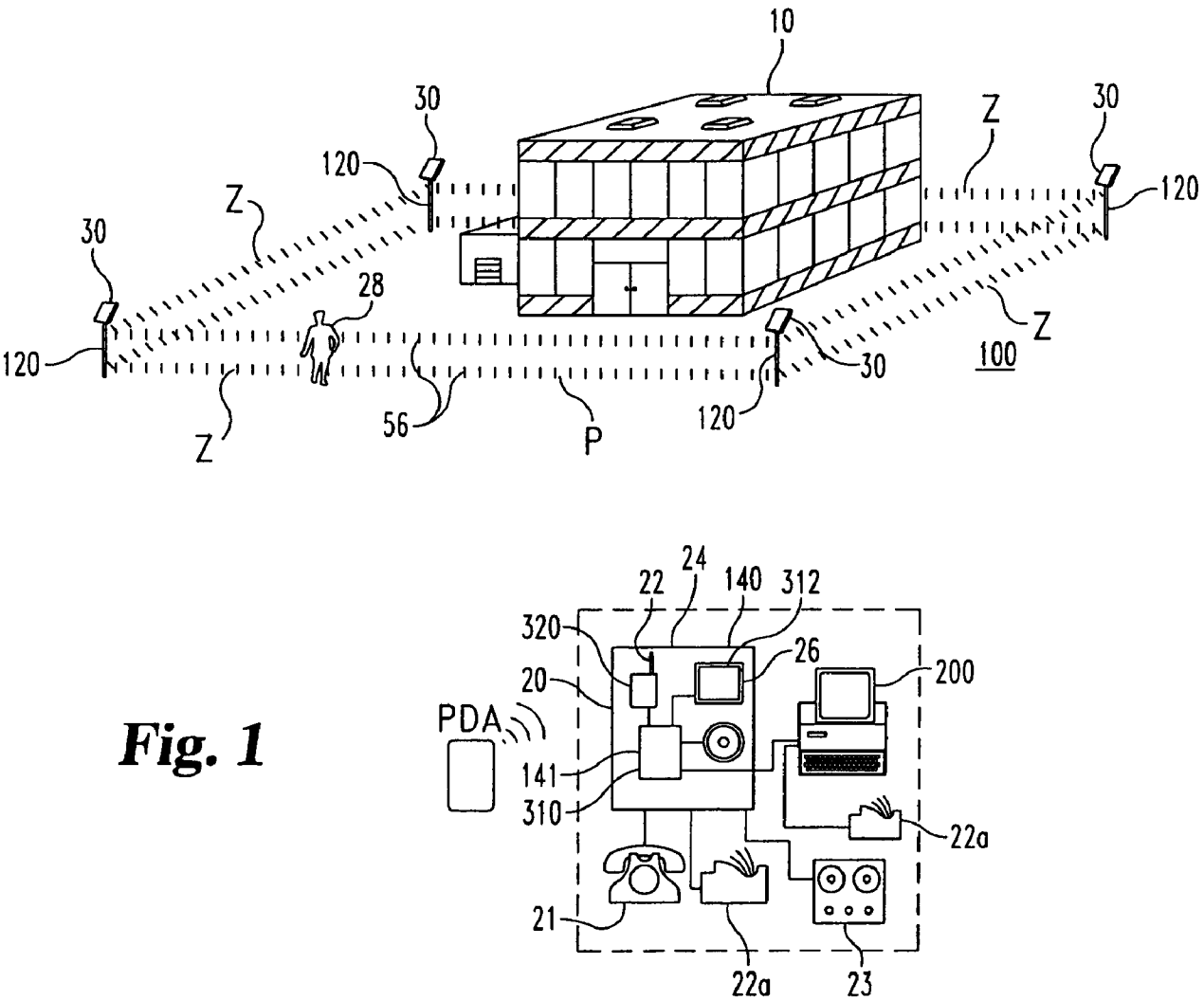
FIG. 1 depicts a security system employing solar towers for emitting a detection beam and a remote central unit, according to the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

FIG. 1 is a perspective view illustrating a security system 100 employing solar towers 120 for detecting an intruder 28. The security system 100 includes a receiver/processor and transmitter unit 20 communicating with electronic devices in the solar beam towers 120, the receiver/processor and transmitter unit 20 having an antenna 22, housing 24, and an indicator 26. In specific versions of the security system 100, the receiver/processor and transmitter unit 20 may be a single unit (such as a transponder) having an antenna 22, housing 24 and an indicator 26. In other versions, the receiver unit and processor unit and transmitter unit are separate, each operatively connected to an antenna 22 and an indicator 26. The indicator 26 includes information on the location of an intrusion. In the security system 100 of FIG. 1, a photo-electric detection beam is used to detect intruders; however, an infrared beam, a laser beam, a microwave beam, a visible light beam, microphonic (acoustic detection) cables, ultrasound waves, radar waves, or any combination of detection beams may be used. In water applications, the detection beam may be sonar waves.

The alarms sent out by the solar powered perimeter beam apparatus 10 comprise at least one of an audible alarm, a visual alarm, a telephone dialer, a printer, a recording device, and a satellite uplink.

The central (radio) unit of the present invention can exchange information between the remote units via a two way half-duplex radio. The solar powered perimeter beam apparatus 10 according to the present invention is a radio data reporting system, which reports events and transmits an alarm when the detection beam is breached. The detection alarm is transmitted to the central unit when a new event is detected, and it is displayed there.

The security system 100 is a supervised-wireless perimeter security detection system for outdoor applications. The security system 100 provides easy deployment and installation.

The security system 100 includes a plurality of solar towers 120, each having beam devices 132 comprising a detection beam generator 130 for generating the detection beams B which extend between adjacent solar towers 120, and a master control receiver 140 which is a radio communication system corresponding to the receiver/processor and transmitter 20 of FIG. 1, and is alternatively designated processing unit 141. The towers 120 are arranged to define intrusion detection zones Z between each pair, and collectively provide a security perimeter P, which can also be regarded as an intrusion detection zone or area.

The parts used in the solar towers 120, described below, are preferably constructed of polycarbon plastic. Any other suitable materials, within the ambit of one ordinarily skilled in this art, are also contemplated as being within the scope of the present invention.

Figure 2:
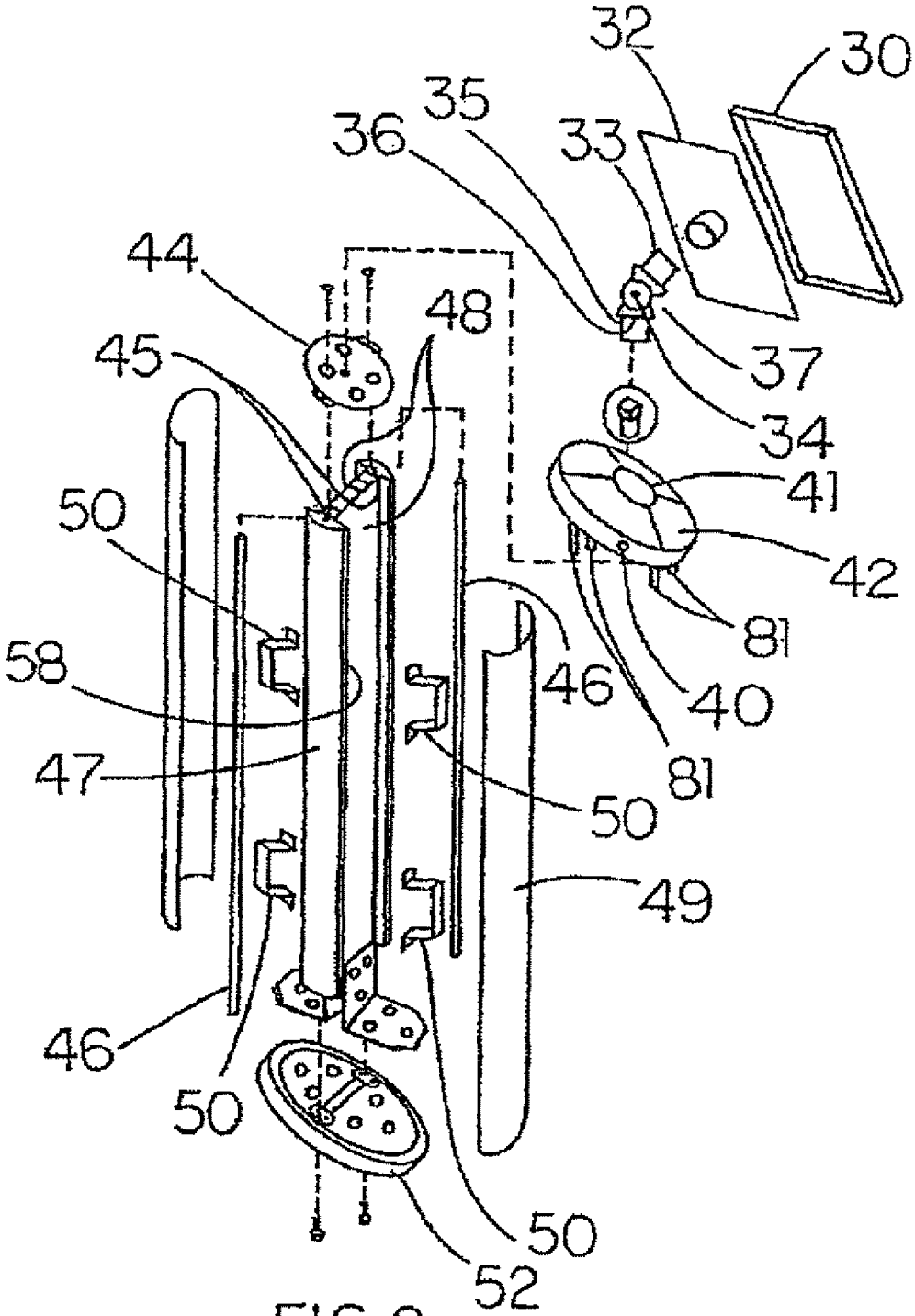
FIG. 2 is an assembly view of a solar tower according to the present invention.

FIG. 2 is an assembly view of one of the solar towers 120. The security system 100 of FIG. 2 includes a 20 watt solar panel 30, a stainless steel solar mounting bracket 32, a swivel clamping bolt 34, a swivel bracket O-ring 36, a swivel solar bracket 37, a solar cap O-ring 38, a solar cap opening mechanism 40, a solar base cap 42, and a stainless steel top plate 44. The security system 100 also includes frame support rods 46, a frame unit 47 (shown in FIGS. 4 and 5), a six inch frame tower 48, face shields 49 (shown in FIG. 9), a battery clamp 50, a base unit 52, and face shield slots 58 (shown in FIG. 6).

The stainless steel solar mounting bracket 32 is mounted to the top of the swivel solar bracket 37, and the power cable from the solar array (not shown) passes through the center of the metal plate into the top of the swivel solar bracket 37. The swivel solar bracket 37 is preferably a two-piece polycarbon swivel bracket that clamps together to allow the solar array panel to be positioned at different angles for viewing the sun. The top piece thereof attaches to the solar mounting bracket 37, and the bottom piece will be inserted inside the swivel solar bracket 37, and the bottom piece will be inserted inside the swivel solar bracket 37 and through the top portion of the solar base cap 42.

The solar base cap 42 and the solar cap opening mechanism 40 (located inside the housing of the cap 42) permits access into the tower 120. A special key may be used, for example, to raise and lower the solar cap 42, using a drill or a screw-type shaft positioned in the center of the solar cap 42. Four alignment pegs 81 allow the solar cap 42 to move freely up and down. A recessed opening in the solar cap 42 allows the swivel solar bracket 37 to be inserted along with a power wire.

Bolts are used to clamp together the top plate 44, the two frame rods 46, and the frame unit 47. The frame unit 47 has a six foot main body which slides over the frame support rods 46 and attaches to the base unit 52. The clamping plate (stainless steel top plate 44) bolts to the support rods 46, giving all three components the strength needed. Open channels inside the solar tower 120 frame allow for the wiring of the equipment (not shown) to be installed inside the solar tower 120 frame.

The base unit 52 is preferably an oval-shaped polycarbonate member which is about eight inches wide, twelve inches long, and two inches high. The base unit 52 is used to secure the main solar tower 120 frame to the ground. In addition, the base unit 52 bolts to the support rods 46 to clamp the solar tower 120 frame unit together. In other versions, the base units 52 of the towers 120 are not secured to the ground. Base units 52, in this version, are provided with means by which the towers may be moved from one position to another as desired to define the desired intruder detection area. The intruder detection area is fully defined by the detection beams extending between the towers.

Figure 31:
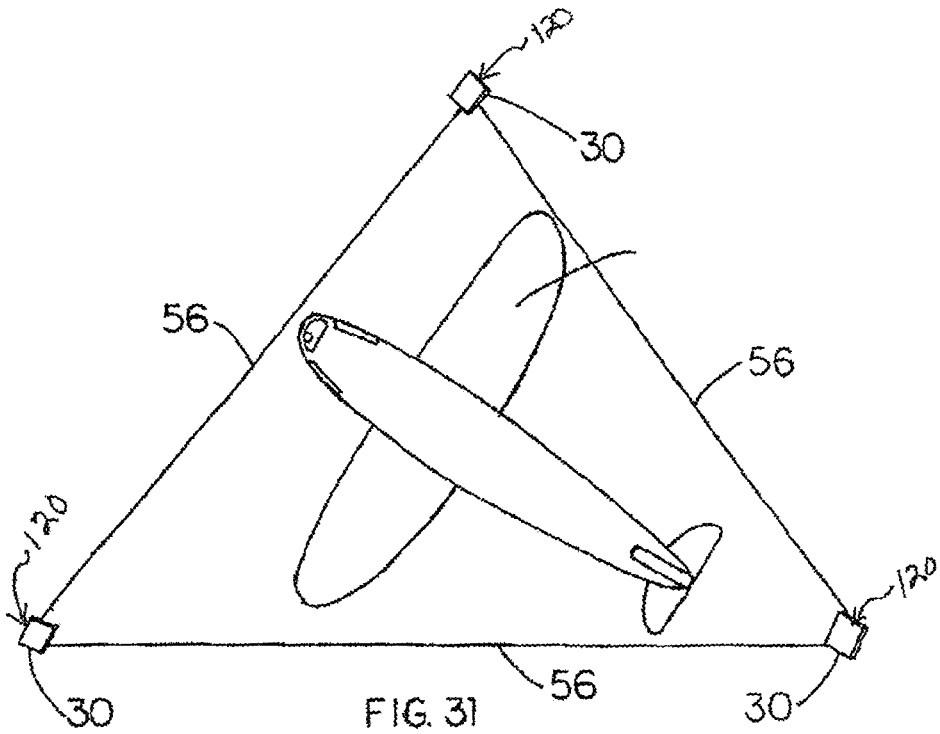
FIG. 31 is a top view of another version of the security system employing solar towers according to the present invention.
Figure 32:
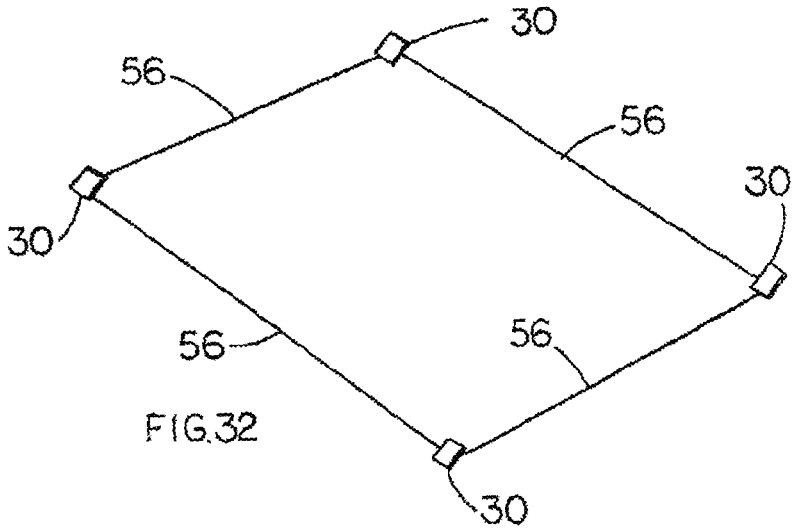
FIG. 32 is a top view of still another version of the security system employing solar towers according to the present invention.

In the simplest form of the invention, the intruder detection area is in the shape of a triangle with a tower at each of the base angles and the apex angle of the triangle. See FIG. 31, for example. In various versions, at least one of the towers is movable as desired. In other versions, two of the towers are movable with one of them being fixed. In another version, all three towers are movable, and in still another version, two of the towers are fixed and one of the towers is movable. In this version, the detection beam generators 130 and detection beam detectors 132 of adjacent towers are precisely aimed at each other such that the perimeter of the triangular secured area is totally defined by the detection beams extending between adjacent towers and the movement of any one tower will cause a change in the angles defined by the detection beams extending between all three towers and one or more of the detection beams will not be appropriately received by a detection beam detector and the alarm will sound as if an intruder had passed through one of the detection beams and interrupted the perimeter defined by the detection beams.

Each of the secured intruder detection areas in this version is a combination of a multi-sided geometrical area defined by straight lines. Each of said areas consists of a plurality of contiguous triangular areas with a tower at each base angle and apex angle. Each of said detection areas thus has a tower at each angle of each triangular portion thereof. Each of said towers has a plurality of receivers, processors, and transmitters.

In each multi-sided geometrical area defined by the detection beams extending between the towers, some of the towers may serve more than one of the plurality of continuous triangular areas so as to be located at the angles of several of the plurality of contiguous triangular areas of the multi-sided geometrical area defined by the detection beams extending between the towers.

Figure 33:
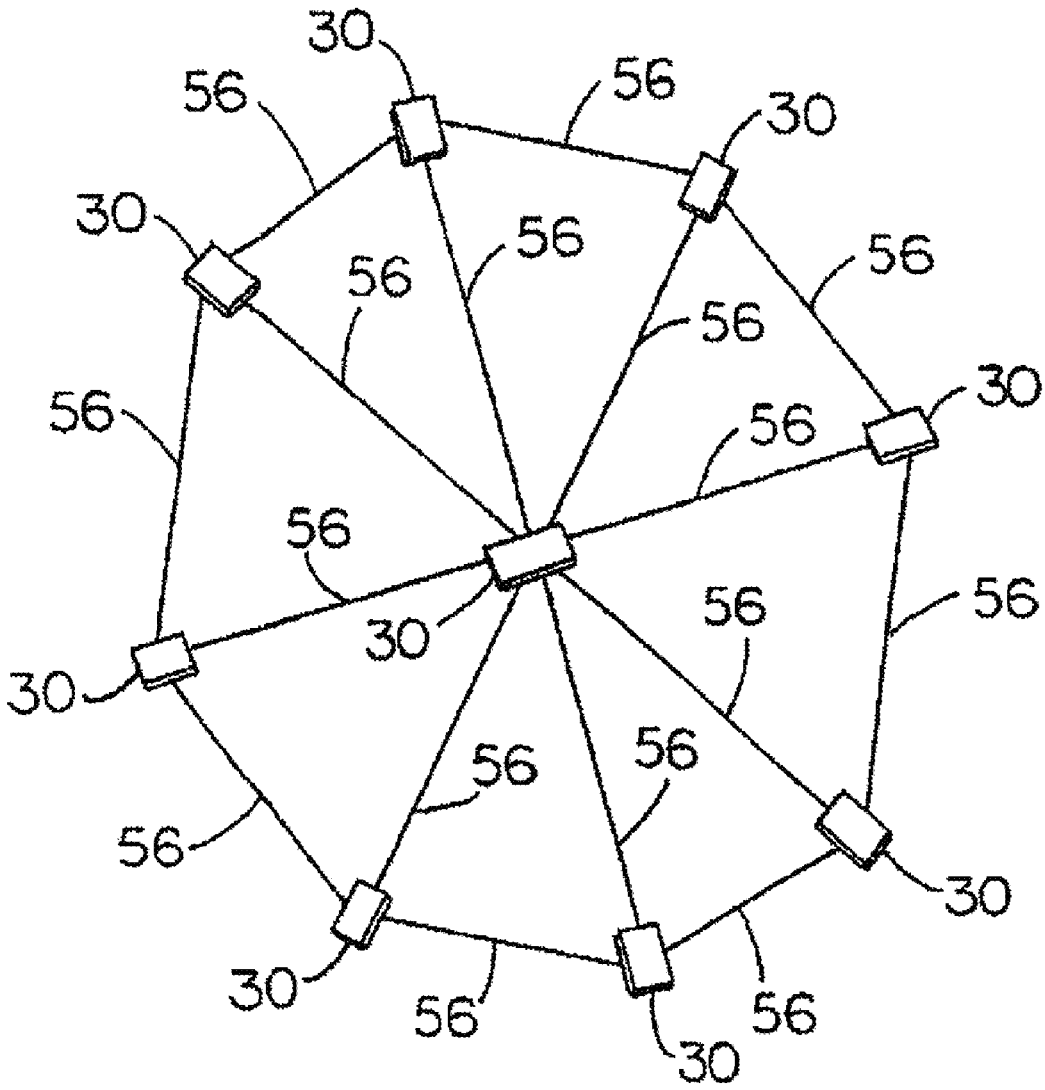
FIG. 33 is a top view of still another version of the security system employing solar towers according to the present invention.

Each of these towers would serve more than one triangular area and be provided with more than two receivers, processors and transmitters. For example, in a pentagonal geometrically shaped intruder detection area, there may be six or more spaced perimeter towers in a circular configuration between which detection beams extend with a central tower equally spaced from all of the perimeter towers which receive and send the detection beam back to each of the perimeter towers. Thus, the central tower serves all of the different triangular detection areas that make up the pentagonal intruder detection area. The central tower would have multiple detection beam generators and multiple detection beam detectors whereas each of the perimeter towers would have either one detector and two generators or two detectors and one generator as the case may be. See FIG. 33, for example.

Figure 30:
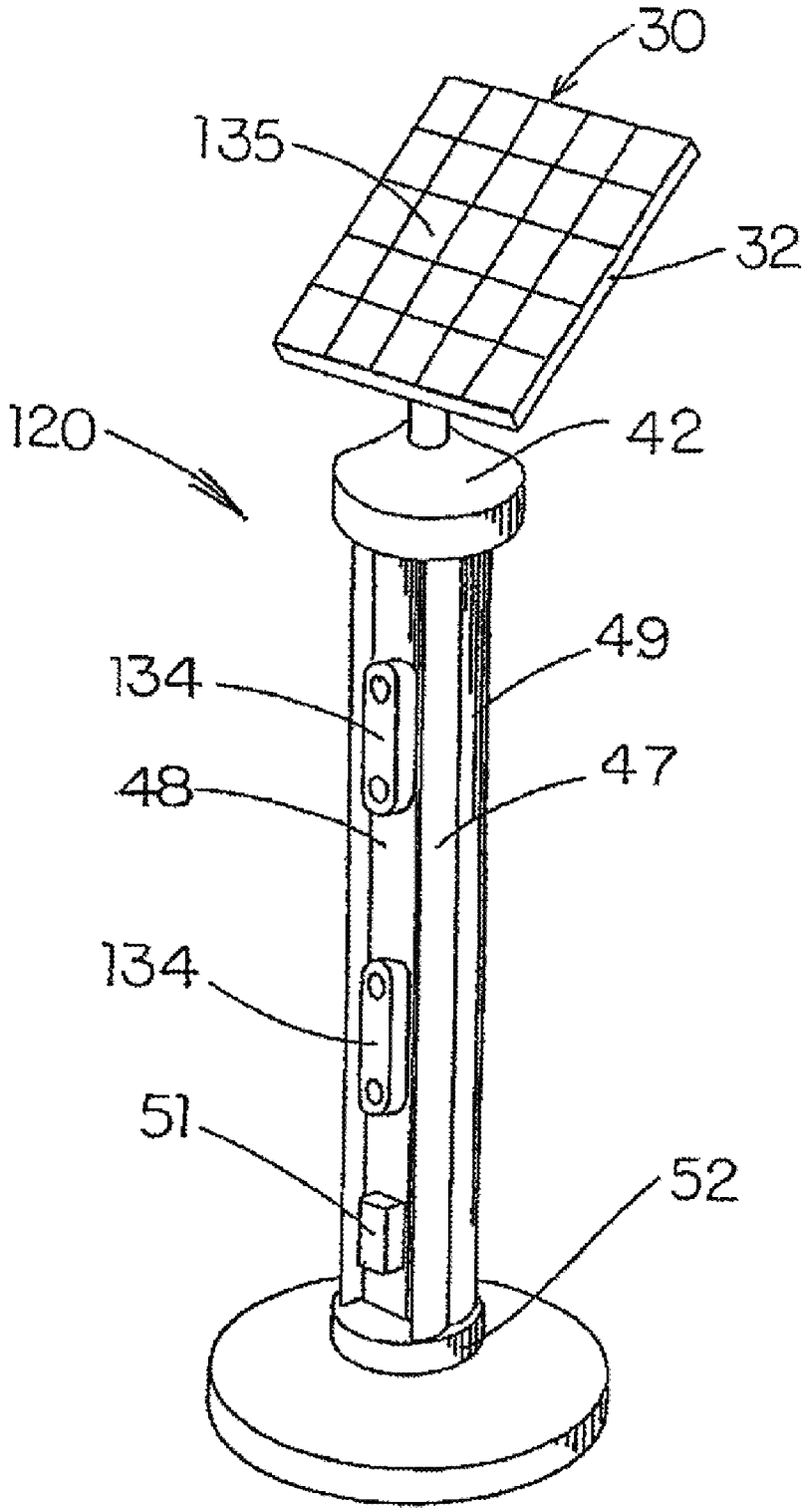
FIG. 30 is a perspective view of the perimeter beam tower with one of the face shields removed.

In still other versions, the intruder detection area may define a geometrical area that is a parallelogram. Each of the parallelogram areas may be defined by two contiguous triangles or four contiguous triangles depending upon whether or not a detection beam is extended between one pair of opposite towers or both pair of opposite towers. Parallelogram areas may be defined by multiple contiguous triangular areas as illustrated in FIG. 30.

In each of said towers, the detection equipment, such as beam generators and the beam detectors, can be aimed separately so as to send and receive the detection beam as desired. Each detection beam has a central axis which is positioned in the center of each generator and each detector and a cross-sectional area which is superimposed on the detector areas before the detection beam generators and detectors are fixed in each tower. Once fixed, any attempt to move the tower or to change the directional setting between the detection beam generators and detection beam detectors will set off the alarm.

The security system 100 also includes the face shields 49 (shown in FIG. 9), which are also preferably made of polycarbon plastic, and are U-shaped (i.e., shaped in a half-oval pattern). Each piece is about 5½ inches wide and six feet high. The face shields 49 are inserted into the base unit 52 first. Then, the face shields 49 are inserted into channels in the frame unit 47. The frame support rods 46 are preferably aluminum poles six feet high and ¾ inches in diameter. At each end of the rods 46 are welded-on nuts that bolt the base plate (base unit 52), the frame unit 47, and the clamping plate 44.

Figure 3:
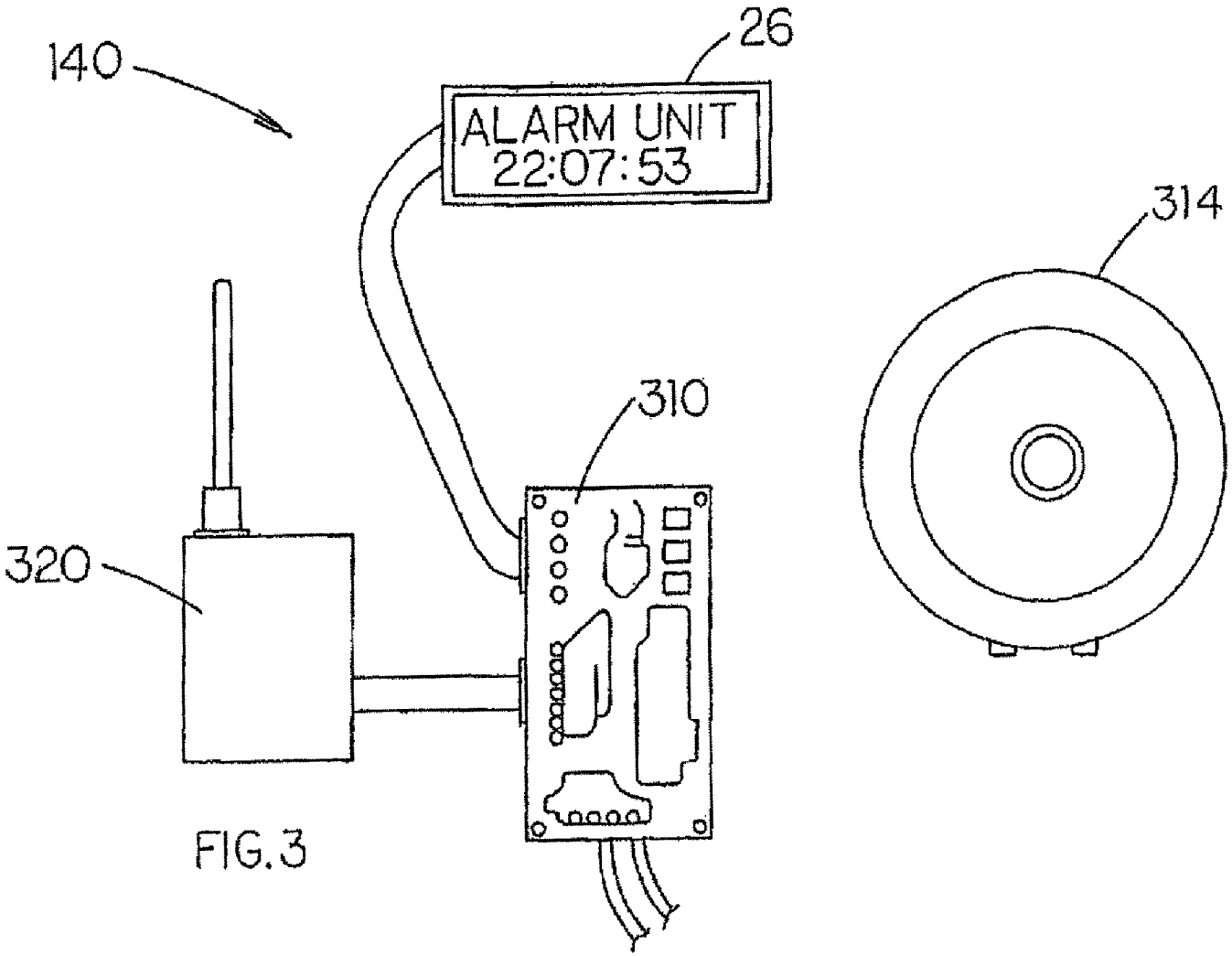
FIG. 3 is a front view illustrating a central unit circuit board, a radio transmission/reception device, a display and a speaker for a security system according to the present invention.

FIG. 3 is a further view of receiver 140 having a central unit circuit board 310, a radio transmission/reception device 320, a display 312, and a speaker 314 used to sound an alarm. (See FIG. 10 also). The radio transmission/reception device 320 is preferably an FM RTX radio. The security system as a whole includes at least two half-duplex two-way radios. This type of half-duplex system substantially prevents sabotage and detects intentional radio jamming. The central unit circuit board 310 includes a CPU which communicates with the display 312 to indicate time, actions, and status of remotes (digital alarms and analog signals, battery voltage and board temperature). This central unit circuit board 310 has sufficient memory to provide capability of storing events and printing them on an external standard printer (See printers 22*a* of FIG. 1, for example).

One having ordinary skill in the two-way radio transmission art would understand how to embody the elements and connections necessary to carry out the above-described functions. In one nonlimiting form, VHF or UHF radios are used to provide a 1-5 mile transmission range with 2 or 5 Watt transmission power levels, and/or a short range radio is used such as that provided by INOVONICS, which operates with about a 900 MHz carrier and has a range of 1500-5000 feet. In still other embodiments, a different radio and/or wireless communication arrangement can be utilized.

Figure 4:
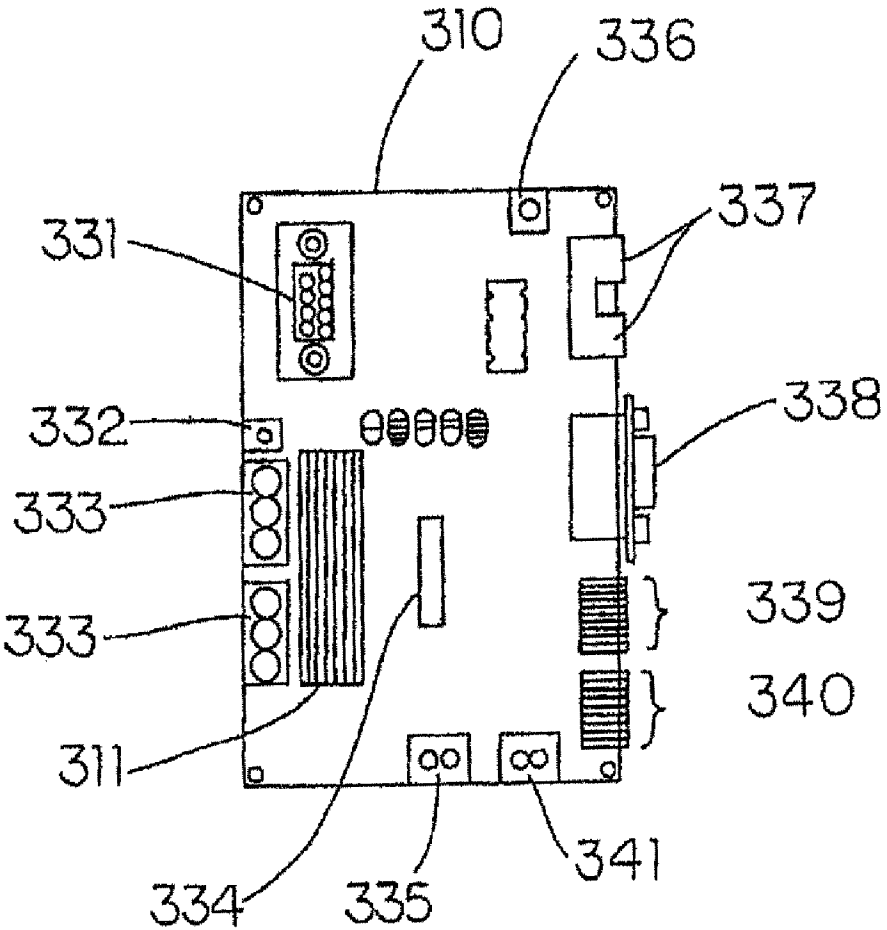
FIG. 4 is a front view of the central unit circuit board illustrating connections for various working components to be connected to the back side of the central unit circuit board of FIG. 3.

FIG. 4 is a perspective view of working components mounted on the circuit board 310 of FIG. 3. The central unit circuit board 310 of FIG. 4 includes a programming socket 331, a speaker output connection 332, and an alarm relay output connection 333.

The central unit circuit board 310 also includes a clock battery 334, a 12 volt DC battery 335, a display contrast control 336, and a display/printer output port 337. The central unit circuit board 310 further includes a connector for an FM radio 338, a connector for a CPM-016-FM radio 339, a connector for a CPM-016-AM radio 340 (which is a connection for a standard ON-OFF-keying half-duplex radio), and a supply/charger connection 341 which is preferably made for connection to a source of voltage in the range of 14.5 volts DC to 18 volts DC and which is switchable to put the unit ON-OFF.

In FIG. 4, the programming socket 331 is used to program the central unit circuit board 310 by an external PC 200. (See FIG. 1, for example).

Figure 5:
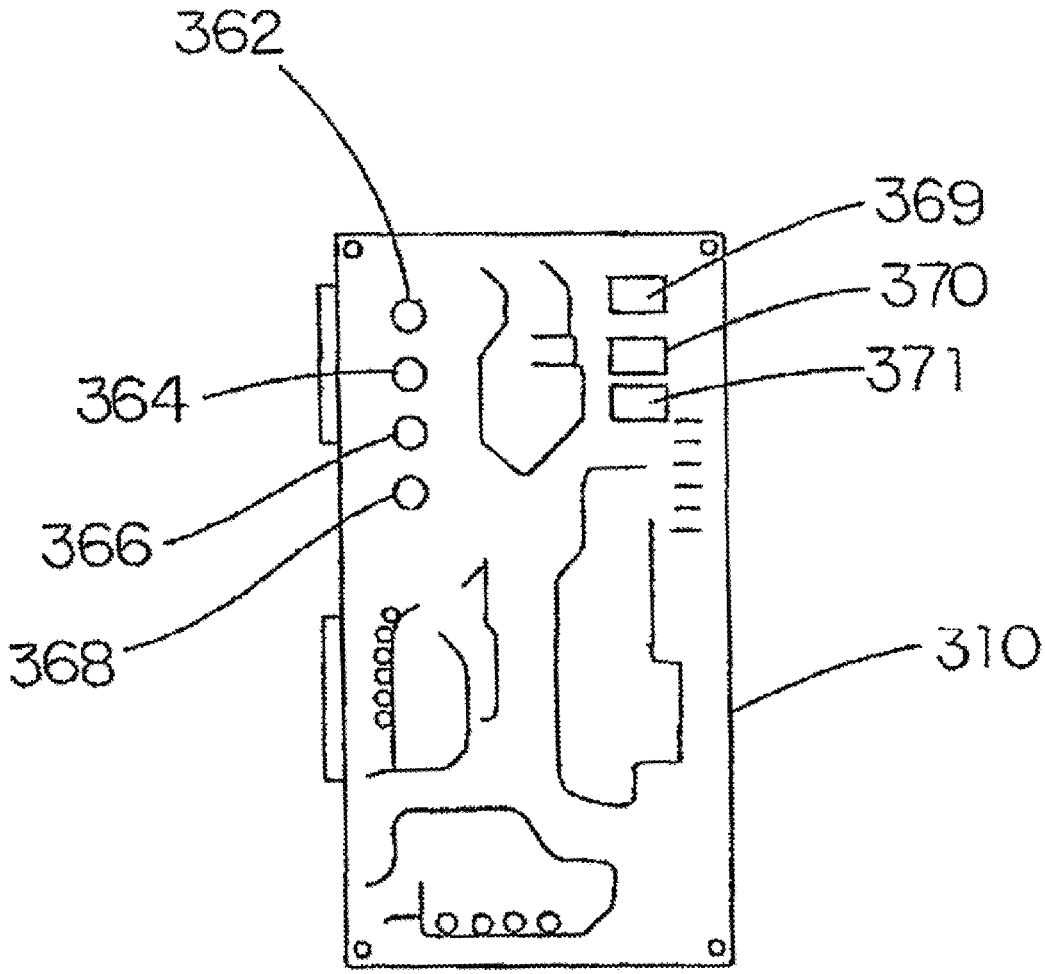
FIG. 5 illustrates various LED's and pushbutton control features on the front side of the central unit circuit board.

FIG. 5 illustrates the central unit LED's and pushbuttons on the central unit circuit board 310. Specifically, FIG. 5 shows that the central unit circuit board 310 includes an "ON" LED 362 which is lit when the battery and/or power supply is present on board, a "CLOCK" LED 364 (flashing at one pulse per second, indicating that the CPU is working), and an alarm memory LED 366 which is "ON" when an alarm has been detected and not yet reset.

The central unit circuit board 310 of FIG. 5 also shows a fault memory LED 368 which is "ON" when a telemetry fault has been detected and is not yet reset, and a reset button 369 which can be pushed to test the whole system after an alarm or fault detection, in which a polling cycle will be executed to all remotes. The central unit circuit board 310 includes a clock/up button 370 and a set clock button 371.

The buttons 370 and 371 are preferably used in combination to set a time, or change a time. Such operations, in many variations, are well known and are therefore not described further herein. It would be within the ambit of one having skill in the digital clock setting and control arts to configure, design, and/or make such a clock setting arrangement.

Figure 6:
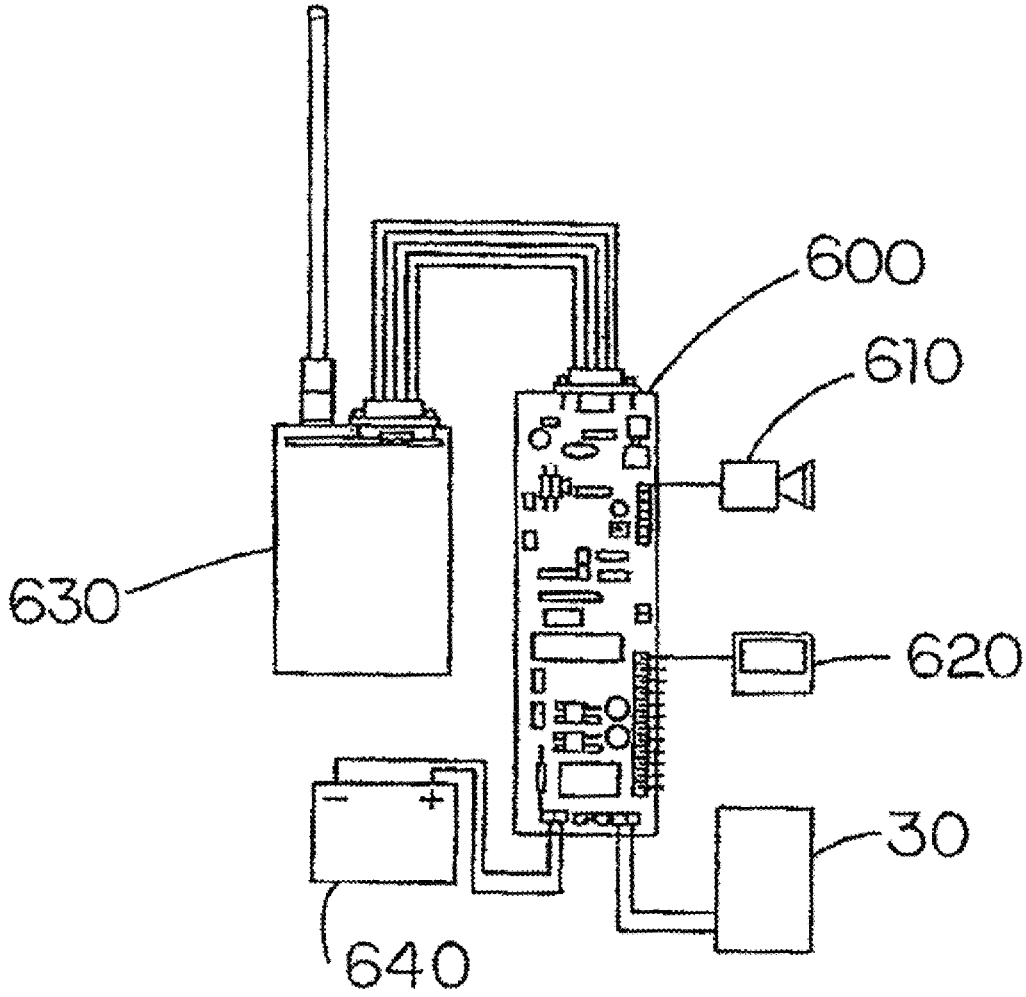
FIG. 6 illustrates an embodiment of the receiver/processor and transmitter unit having a radio transceiver unit, a remote controlled camera and detector.

FIG. 6 illustrates a remote unit board 600 and associated devices. Specifically, FIG. 6 shows an Rtx radio 630, a remote controlled camera 610, and a radiation detector 620. The remote unit board 600 is preferably a CPU equipped PC board having 12 volt DC operation, a solar panel/charger circuit, three different radio interfaces, a temperature sensor, a battery voltage sensor, four analog input channels (two of which are for temperature and battery voltage), a settable threshold for the four channel analog IN to generate an alarm, an eight digital alarm in—optical decoupled—normally low, a bi-directional polling and/or simple one-way only transmission (using dip switch settings), dip switch time settable telemetry transmission in the "only TX" equipped systems, a local check up capability to test the radio reception, and remote unit identification by dip switch settings.

In one configuration, at least two of the digital inputs are utilized to indicate corresponding diagnostic remote alarm conditions: (1) mechanical tampering or damage of the tower as indicated by a reed switch sensor, shock sensor, or the like and (2) fog presence, which may be detected as a function of humidity, temperature, and atmospheric pressure and/or with a dedicated sensor. Further, it should be appreciated that analog inputs corresponding to temperature, battery voltage and/or current, and solar panel voltage and/or current can be utilized to ascertain power availability and detect/report suspected failures or related problems. Accordingly, in addition to intruder information, tower tampering, tower damage, tower malfunction, and various tower environmental conditions can be advantageously reported by wireless communication techniques to the central station as part of the standard operation of the system.

Figure 7:
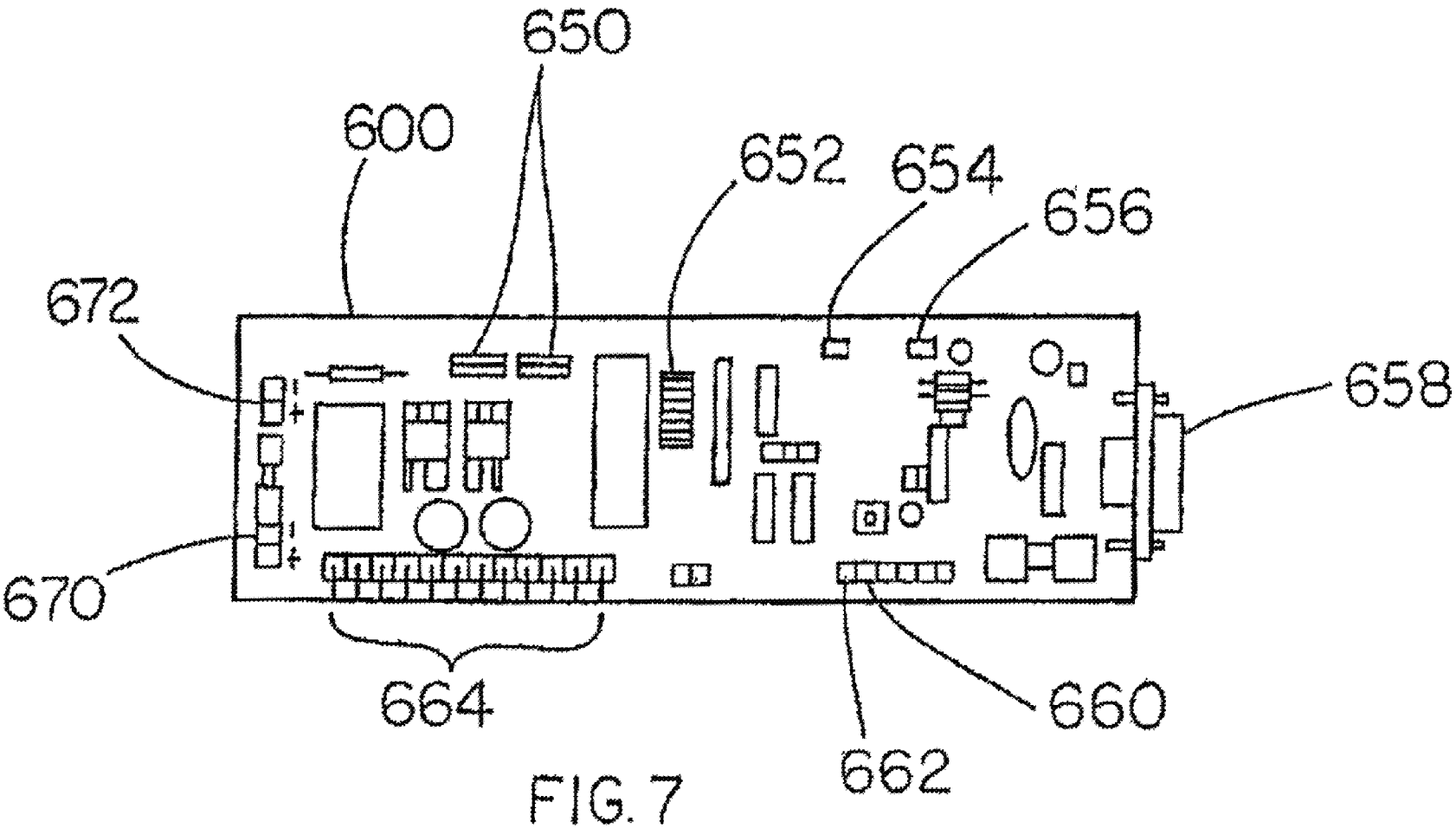
FIG. 7 is a front view of the remote unit board illustrating connections for various working components to be connected to the remote unit board of FIG. 6.

FIG. 7 illustrates a connection of the remote unit board 600 of FIG. 6. In this view, the remote unit board 600 includes a relay out 650 for contacts out for a remote command from the central unit 310 (to switch ON-OFF a radio, camera, flashlight, etc.), a connection for an ID number 652, a connection for a CPM-AM radio 654, a connection for a CPM-FM radio 656, a connection for an FCC FM radio 658, a reset button/switch 660, and a connection 662 for receiving/transmitting a setting and a transmission time. The remote unit board 600 also includes a digital and analog "in" connection 664, a charger/solar panel power "in" connection 670, and a 12 volt DC battery "in" connection 672.

At the connection 664, it is possible to connect with eight digital alarm inputs and two analog inputs (0.25 volt DC ground ref., 01. volt DC res.). To generate an alarm, the digital input must be between 5 and 18 volts DC, at 10 mA.

Figure 8:
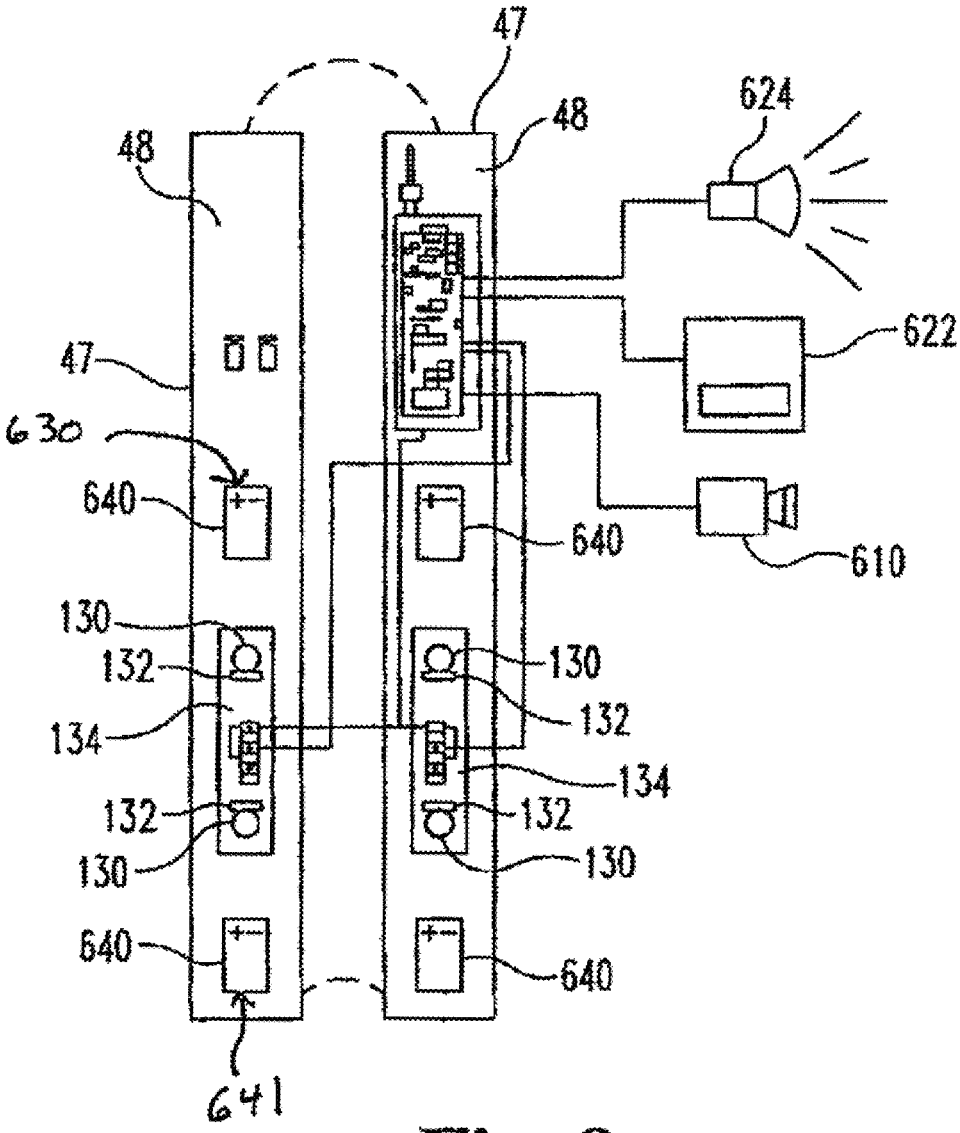
FIG. 8 is a split view of two faces on a solar tower beam unit as shown in FIG. 2, and carrying the electronic elements thereon.

FIG. 8 is an elevational view of a complete solar tower beam unit as in FIG. 2, and carrying the electronic elements thereon of FIGS. 3-7. FIG. 8 depicts a dual beam system. In FIG. 8 tower 120 includes detection equipment 134. For each tower 120, detection equipment 134 includes two beam generators 130 and two corresponding beam detectors 132. Also shown is electric power source 630 that includes an electrical energy storage device 640 in the form of a battery 641 of electrochemical cells.

Figure 9:
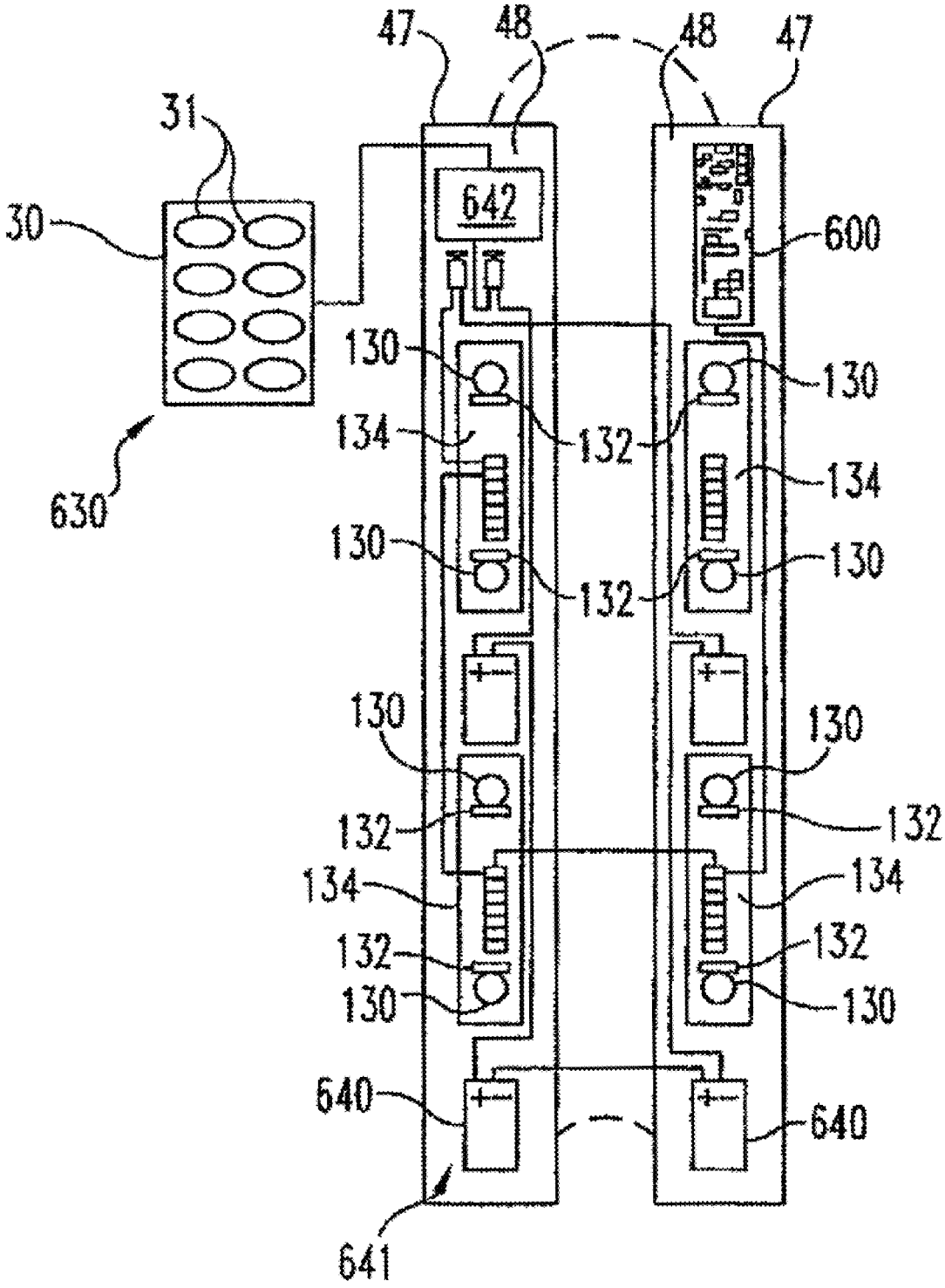
FIG. 9 is a split view of the solar tower beam unit of FIG. 8 showing the electrical power supply connections therein.

Referring also to FIG. 9, a guard beam form of tower 120 is illustrated; where like reference numerals refer to like features. FIG. 9 further schematically depicts solar panel 30 with solar-to-electric energy converters 31. Source 630 is illustrated as being inclusive of panel 30 and charge/storage circuitry 642 which is coupled between panel 30 and device 640 to provide for the storage of electrical energy in device 640 from panel 30. Electric power consuming devices of power 120 are powered by source 630 as described throughout the present application.

The solar power security system 100 is a supervised, wireless perimeter security detection system for outdoor application, featuring easy deployment and installation. Individual solar towers 120 are custom designed to cover the area to be protected, including the features and options selected. Upon receipt, the solar towers 120 are bolted to their respective concrete base unit 52, the beam devices 130 are aligned, and the master control receiver 140 is plugged into a suitable electrical outlet.

Figure 10:
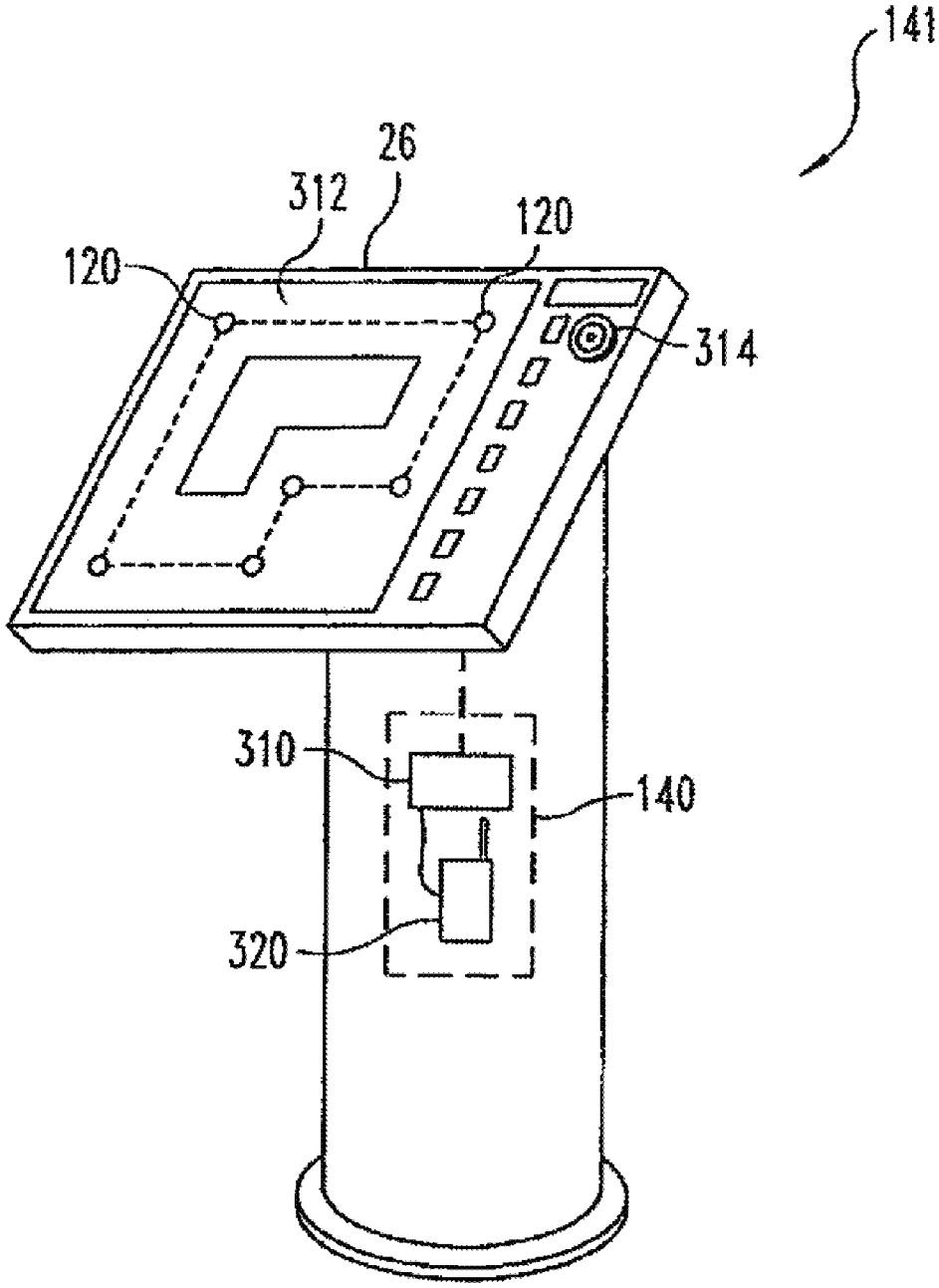
FIG. 10 is a perspective view of an embodiment of a display panel for a central unit.

Referring additionally to FIG. 1, the master control receiver 140 (also designated processing unit 141) and display panel 312 are installed in a guardhouse or central monitoring location. A perimeter light and voice annunciation system will disclose the exact zone and location of any alarm signal received. Red and yellow LED lights located around the display panel will show all activity from the solar beam towers 120. The red light indicates an alarm condition and the yellow light represents the zone(s) bypassed. An RS 232 connection port is provided for remote video camera signals. FIG. 10 illustrates a control panel/display form of processing unit 141; where like reference numerals represent like features. In one particular form, the central station operator can input a "bypass schedule" that designates certain areas to be bypassed (not monitored) with the system during certain time periods on a recurring or nonrecurring basis. For example, it may be desirable to monitor a given entranceway only at night and/or to monitor a swimming pool only during hours when access is intended to be prohibited.

The master control receiver 140 will have the ability to send and receive information by duplex transmission, and provide a complete status of the perimeter security system 100. Bypass buttons and other sounding devices will be installed in the system's display panel 312. All ancillary functions, such as low battery, signal loss, and alarm signals from any tower 120 will also be visible on the display panel 312.

In addition to the zone display panel 312, the receiver 20 can interface with a standard PC computer 200 and software. Computer 200 also includes a display. The receiver 20 works much like the remote transmitters 320 located in the solar towers 120. The receiver 20 uses a standard FCC approved transmitter 320, which is connected to an encoder printed circuit board 310. The encoder board receives dialog from the beam tower 120 transmitter and gives the necessary information output to the display panel 312 and/or computer 200.

In one alternative, towers communicate with the central station over a secure, encrypted wireless data communication network instead of a dedicated radio, such as a wireless computer network corresponding to the IEEE 802.11 standard. This form of communication can be used to communicate with any number of compatible network-interfaced devices such as a printer or wireless bridge to the internet. Correspondingly, communications from security towers and/or the central station to remote computers, Personal Digital Assistants (PDAs), laptops, multifunction digital communication devices and the like can be provided.

The transmitter 320 is preferably a 3 to 5 mile, 5 watt radio transmitter. A decoder is preferably attached to the transmitter via RS 232 cable. The decoder receives dialog from the beam detection unit, which is preferably a Pulnix BPIN200HF, and transmits this information to the receiver. Both transmitter and receiver communicate in duplex mode between the tower (s) and the master control. This allows the control panel to send a signal to the transmitter to verify its status, or to activate the remote camera, check voltage on batteries, or turn on a microphone/speaker module to hear and talk, if needed.

The remote control camera 610 plugs into the existing transmitter, and when actuated, will photograph the activity or violation, and transmit the digital image via the radio transmitter 320. The control receiver 140 located at the guardhouse will receive several photos for printing and documentation. Both still photographs and video transmission are to be considered within the scope of this disclosure.

When a person or vehicle interrupts a beam at one of the remote towers 120, a telemetry radio signal is transmitted to the command or master control receiver 140, designating the exact zone or location of the alarm. The command receiver 140 is designed to notify security personnel via voice and zone display, beeper, hand-held radio or to a 24 hour central station.

The photoelectric beam is preferably a point-to-point multi-level quad beam (four path), having a range of up to 600 feet to 800 feet from tower 120 to tower 120. In this arrangement, all four beam paths must be broken simultaneously to activate an alarm. This reduces false alarms when birds, dogs or other animals pass through the photoelectric beam.

Alternately, a microwave unit may be used typically in a more controlled area, such as prisons or high security level applications. The microwave unit offers total perimeter coverage, but usually for a range of from 15 feet to 150 feet from tower to tower. In other embodiments, an ultrasound beam unit may be used in the controlled area. The ultrasound unit is very similar to the microwave unit. In still other embodiments, a radar beam unit may be used. The radar unit would allow for sensing ground level intruders as well as air intruders. In water applications, a sonar unit could be used in place of the radar unit and could be used to sense underwater intruders. In one particular example, sonar sensing can be used in a swimming pool and wirelessly reported through one or more of the remote towers to indicate if anyone or anything is unexpectedly in the pool. Likewise, sonar can be used to monitor a lake, stream, or pond to determine is there is an undesired presence in such body of water.

Figure 28A:
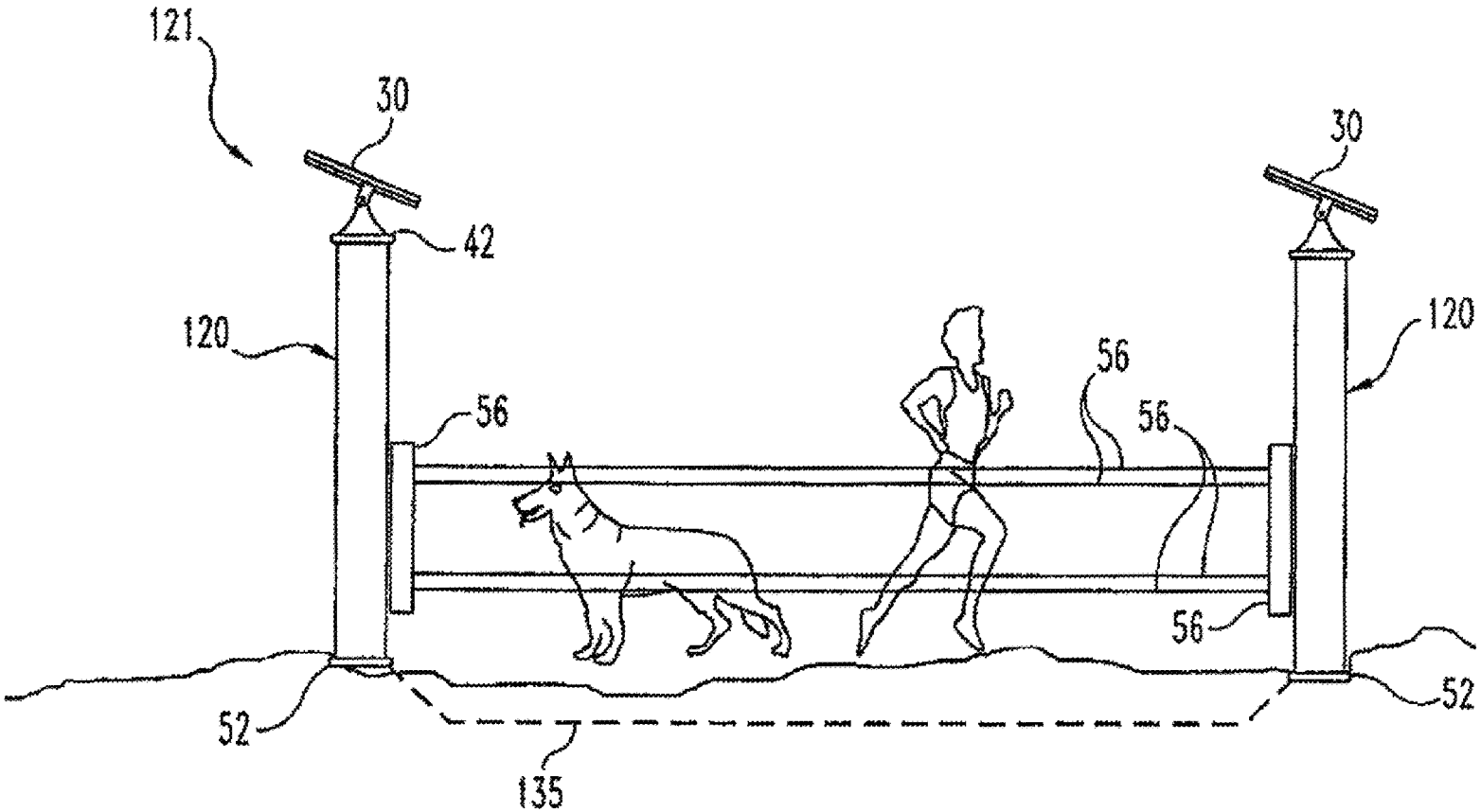
FIG. 28A is a diagram of the perimeter beam tower utilizing a point to point dual detection beam.

In still other embodiments, microphonic cables may be buried underground to detect vibrations or other acoustic disturbances indicative of intrusion. In one form, the cables extend between at least two solar towers 120. Alternatively or additionally, the cables sense pressure from an intruder's weight. One such cable is schematically illustrated in FIG. 28A as designed by reference numeral 135.

The radio communication 320 system can be of several types of systems, depending on the application or range needed. One such system is a short range radio with a range of approximately 1,500 feet from tower to receiver. Another system is a long range transmitter, having a range of up to 5 miles.

Figure 11:
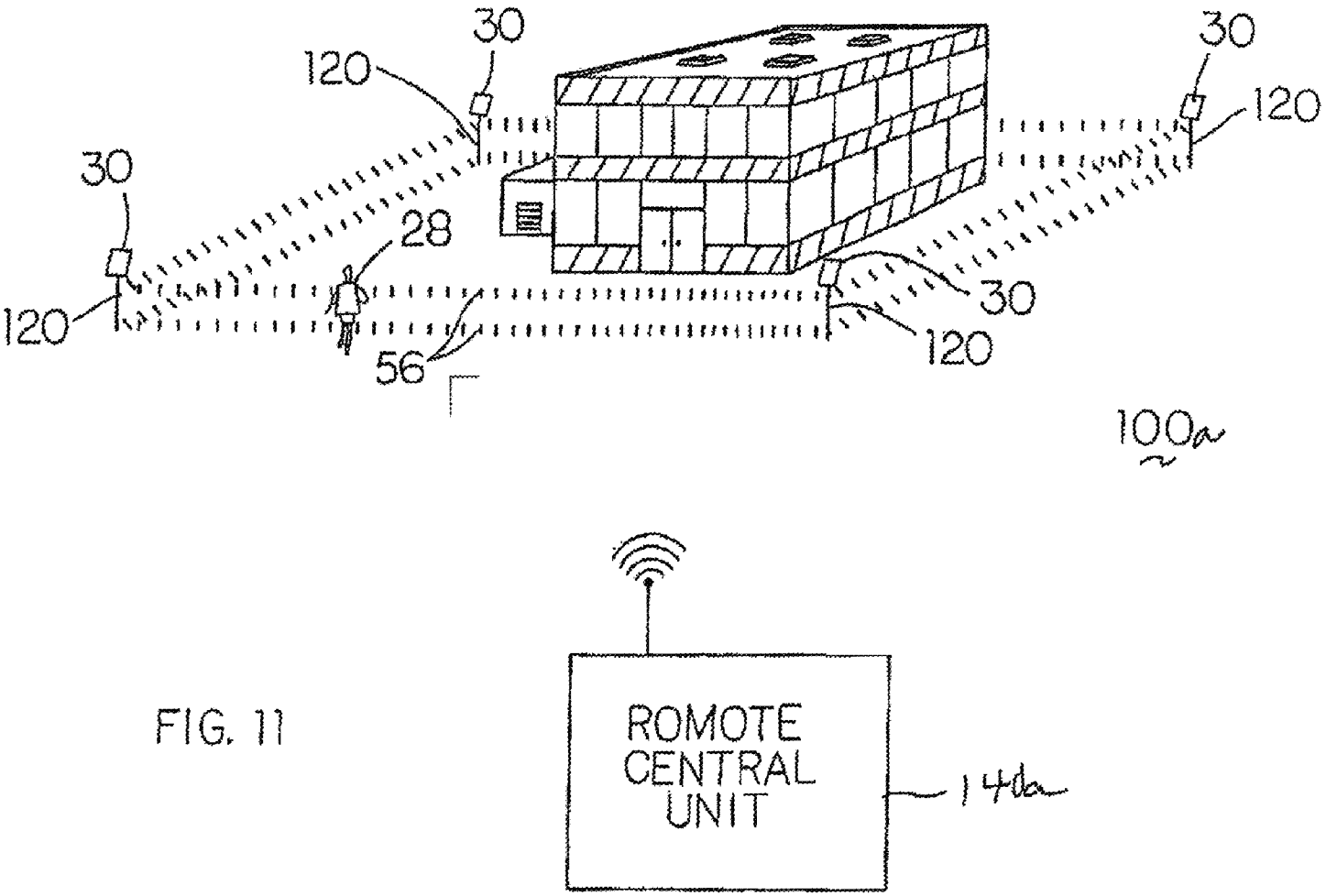
FIG. 11 is a perspective view illustrating a security system employing a plurality of perimeter beam towers according to the present invention.

FIG. 11 is a perspective view illustrating a security system 100*a* employing a plurality of perimeter beam towers 120, for detecting an intruder 28; where like reference numerals refer to like features. The security system 100*a* includes a receiver/processor and transmitter 20 communicating with electronic devices in a remote central processing unit 140*a*. The receiver/processor and transmitter 20 each have an antenna 22, housing 24, and an indicator 26. The indicator 26 includes information on the location of an intrusion. In the security system 100*a* of FIG. 11, multiple detection beams are used to detect intruders 28. The multiple detection beams may include an infrared beam, a laser beam, a microwave beam, a visible light beam, microphonic cables, ultrasound waves, radar waves, or any combination of detection beams may be used. In water applications, the detection beam may be sonar waves. The security system 100*a* is a supervised-wireless perimeter security detection system for outdoor applications. The security system 100*a* provides easy deployment and installation. The perimeter beam towers 120 may be solar powered, or remotely powered where a suitable source of electrical power is available.

The security system 100*a* includes a plurality of perimeter beam towers 120, and at least one detection beam generator for generating multiple detection beams 56. The detection beams 56 extend between adjacent towers 120 and a breach in the detection beams 56 signals an alarm. A remote control master receiver is preferably used to communicate between perimeter beam towers 120. The remote control master receiver is preferably a radio communication system corresponding to the receiver/processor 20 of FIG. 11.

The perimeter beam tower 120 housing 24, described below, is preferably constructed of a polycarbon composite fiber material. However, other suitable plastic or fiberglass materials are also contemplated as being within the scope of the present invention.

Figure 12:
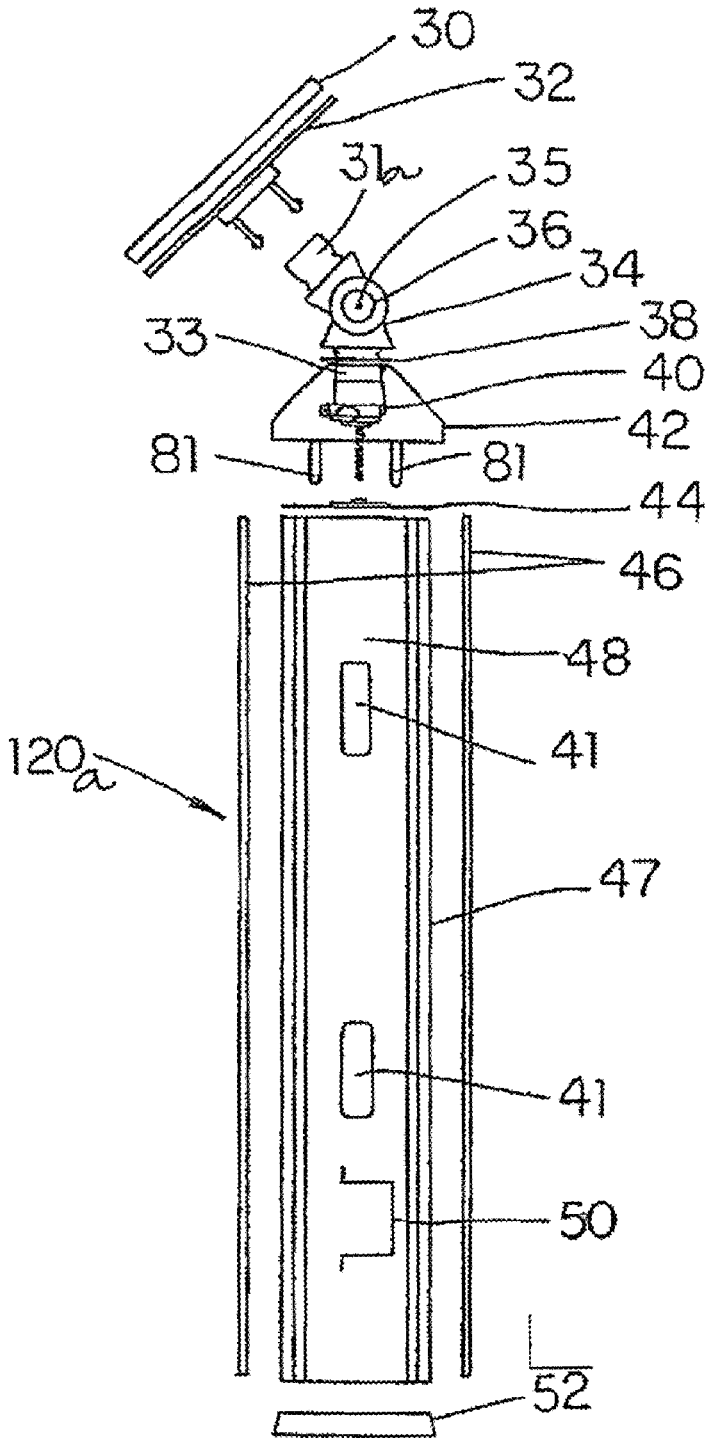
FIG. 12 is an assembly view of a solar powered perimeter beam tower according to the present invention.

FIG. 12 is an exploded assembly view of perimeter beam tower 120*a* powered by a solar panel 30; where like reference numerals refer to like features. Tower 120*a* can be used interchangeable with tower 120 as previously described. Tower

120*a* of FIG. 12 includes a solar panel 30, which is preferably a 20 watt solar panel 30. A solar mounting bracket 32, which is preferably made of stainless steel, or other corrosion resistant materials, is used to secure the solar panel 30 to the upper portion 31*a* of a swivel clamp 34. The upper portion 31*a* of the swivel clamp 34 is adjustably secured to a lower portion 33 of the swivel clamp 34. The upper portion 31*a* and lower portion 33 of the swivel clamp 34 are adjustably secured together with a suitable fastening means, such as a bolt 35. A swivel O-ring 36 is positioned between the upper portion 31 and the lower portion 33 of the swivel clamp 34. The swivel clamp 34 allows the solar panel 30 to be positioned at different angles to better align the solar panel with the sun.

The perimeter beam tower may alternately be powered from a remote power supply source, such as 12 volt, 120 volt, or 240 volt electrical power.

The lower portion 33 of the swivel clamp 34 extends through a solar cap O-ring 38 into a swivel aperture 39 in the solar base cap 42. The solar base cap 42 is mounted upon a top plate 44. The solar base cap 42 has at least two alignment pins 81, and preferably four alignment pins 81, which are received in pin apertures 82 located in the top plate 44. The alignment pins 81 allow the solar cap 42 to move freely up and down.

A solar cap 42 opening mechanism 40 provides access into the housing 24. A power cable 60 extends from the solar panel 30 through the swivel clamp 34 and solar base cap 42, into the housing 24.

At least two support rods 46 are secured to the base unit 52, and extend up to the top plate 44. The support rods 46 are from 5 feet high to 12 feet high, and are preferably from 6 feet to 8 feet high. The support rods 46 are preferably aluminum rods. The frame unit 47 slides over the support rods 46, where the frame unit 47 is secured to the base unit 52. The frame unit 47 is preferably of a height similar to the height of the support rods 46. Open channels 41 inside the frame unit 47 allow for the power cable 60 wiring from the equipment mounted on the solar tower 120*a* to extend through the open channels 41 in the frame unit 47 to the base unit 52.

Opposing face shields 49 are preferably shaped in a half oval configuration, similar to a U-shaped design. The face shields 49 are preferably made of a polycarbon plastic material. The face shields 49 are preferably of a height similar to the height of the support rods 46.

The face shields 49 are inserted into the face shield slots 58 located on the frame unit 47. A suitable fastening means 54 secures the top plate 44 and the frame unit 47 to the support rods 46.

The base unit 52 is preferably an oval shaped polycarbon molded unit, which is secured to the ground, or to a suitable foundation, such as a concrete footing (not shown) or is provided with means allowing movement of said towers when used to define a triangular intruder detections area as above described. The means can be at least three supports chosen from the group of supports including wheels, feet, rollers, skids and combinations thereof.

A stainless steel solar mounting bracket 32 is mounted to the top of the swivel solar bracket 37. A solar array panel is mounted upon the solar mounting bracket 32. A power cable 62 from the solar array panel 30 passes through the center of the solar mounting bracket 32 into the top of the swivel solar bracket 37.

The swivel solar bracket 37 is preferably a two-piece polycarbon swivel bracket 37 that clamps together to allow the solar array panel 30 to be positioned at different angles for optimal alignment with the sun. The upper portion 31*a* of the swivel clamp 34 attaches to the solar mounting bracket 37, and the lower portion 33 of the swivel clamp 34 is inserted inside the swivel aperture 39 in the top portion of the solar base cap 42.

The solar base cap 42 and the solar cap opening mechanism 40 (located inside the housing of the cap 42) permits access into the tower 120*a*. A special key 45 may be used, for example, to raise and lower the solar cap 42, using a drill or a screw-type shaft positioned in the center of the cap unit. Four alignment pegs 81 allow the solar cap 42 to move freely up and down. A recessed opening in the solar cap 42 allows the swivel solar bracket 37 to be inserted along with a power wire. A suitable top plate fastening means 51 is used to clamp together the clamping plate 44, the support rods 46, and the frame unit 47.

The frame unit 47 has a main body which slides over the frame support rods 46 and attaches to the base unit 52 with a base unit fastening means 51. The clamping plate bolts to the support rods 46, giving all three components the strength needed. Open channels 41 inside the frame unit 47 allow for the power cable 60 wiring to be installed. An optional battery clamp 50 may be secured to the frame unit 47 to support one or more batteries 53 within the frame unit 47.

The base unit 52 is preferably an oval-shaped polycarbon member which is about 8 inches wide, 12 inches long, and 2 inches high. The base unit 52 is secured with base unit fastening means 54 to the support rods 46 to clamp the frame unit 47 together.

Each face shield 49 is from 4 to 8 inches wide and substantially the height of the frame support rods 46. The face shields 49 are inserted into the base unit 52 first. Then, the face shields 49 are inserted into channels provided in the frame unit 47.

Figure 13:
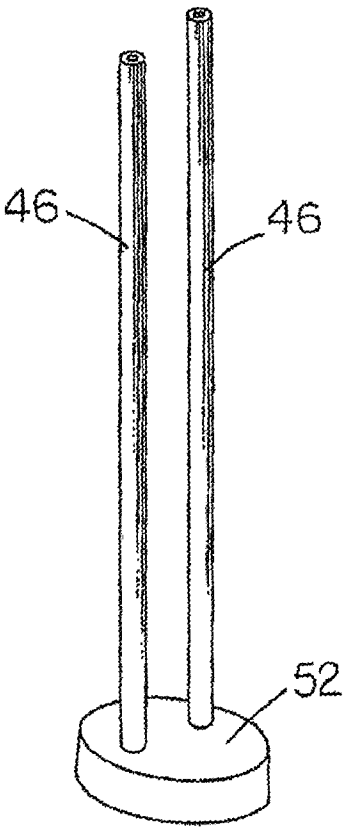
FIG. 13 is a perspective view of a tower housing base unit with support rods extending from the base unit.

FIG. 13 is an elevational view of the frame support rods 46 secured into the base unit 52.

Figure 14:
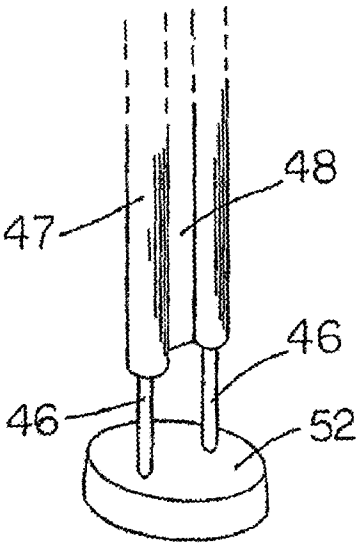
FIG. 14 is a partial perspective view of a tower housing base unit, support rods, and frame unit.

FIG. 14 is a perspective view of the support rods 46 and the frame unit 47 secured to the base unit 52.

Figure 15:
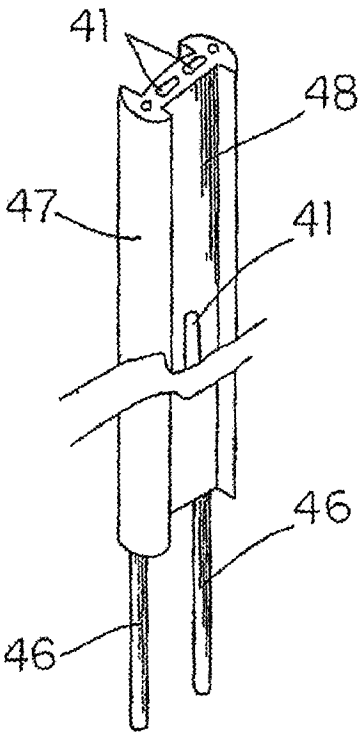
FIG. 15 is a perspective view of a tower housing frame unit inserted over support rods.

FIG. 15 is a perspective view of a beam housing frame unit 47 being installed over the support rods 46.

Figure 16:
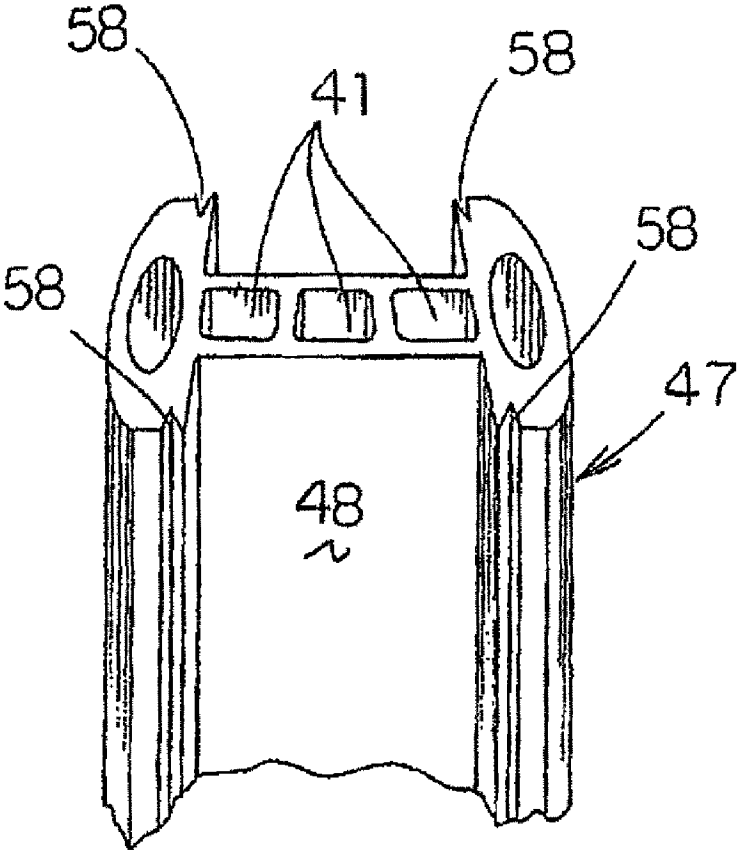
FIG. 16 is a perspective view of a top view of the tower frame unit prior to installation.

FIG. 16 is a top view in perspective of the frame unit 47 having face shield slots 58 and open channels 41 extending the length of the frame unit 47.

Figure 17:
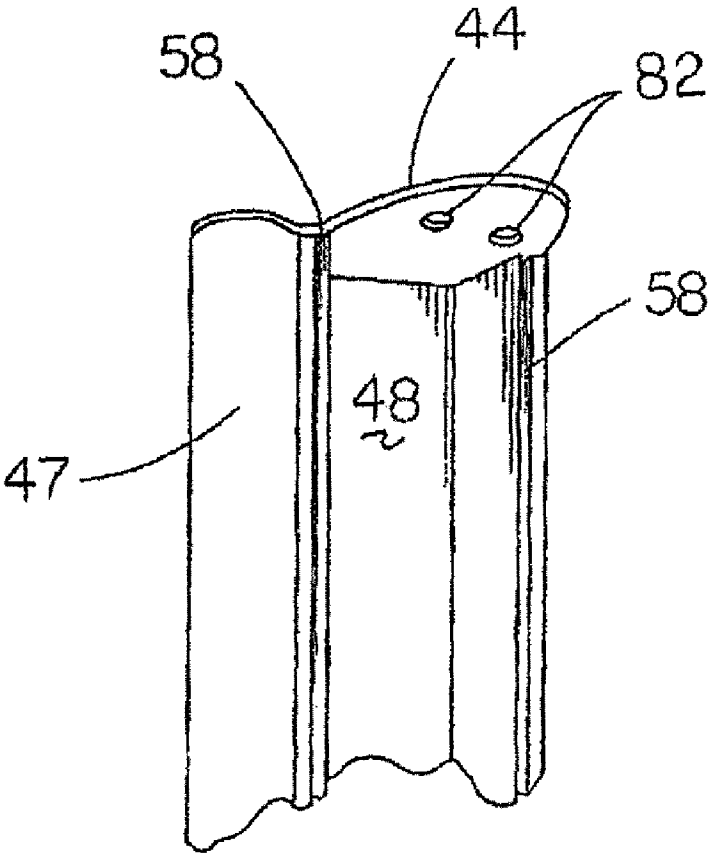
FIG. 17 is a perspective view of a clamping plate being installed upon the frame housing.

FIG. 17 is a perspective view of the beam housing clamping plate 44 being installed on top of the frame unit 47.

Figure 18:
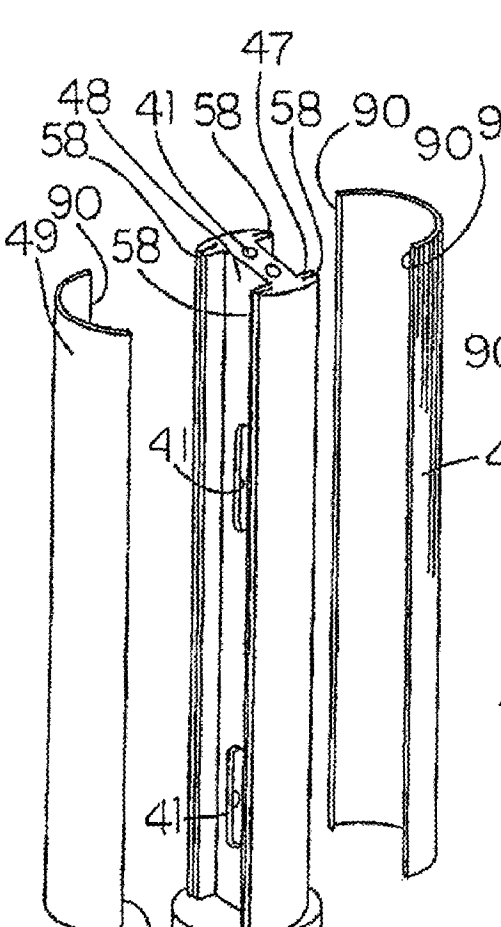
FIG. 18 is a perspective view of a perimeter beam tower during installation, showing a housing frame and opposing face shields.

FIG. 18 is a perspective view of the beam housing frame 47 with opposing face shields 49 prior to installation in the face shield slots 58.

Figure 19:
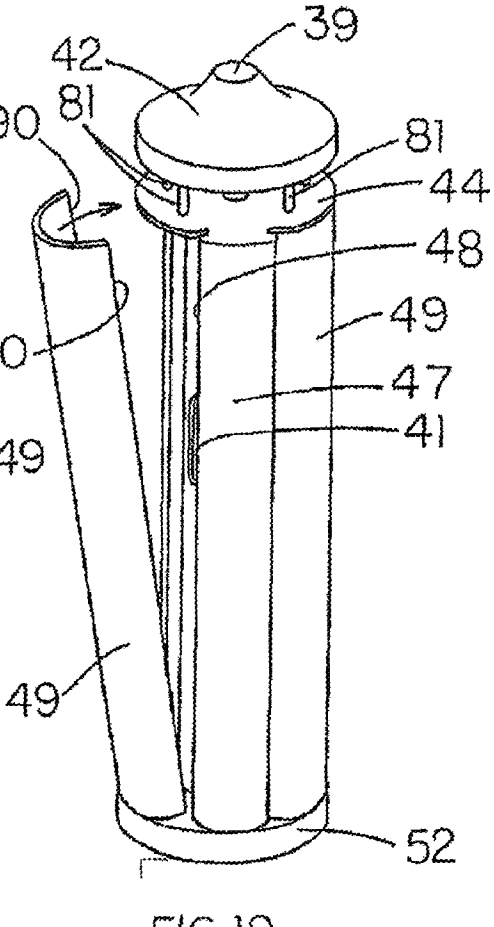
FIG. 19 is a perspective view of a face shield installation (left side) with a base cap positioned over alignment pins.

FIG. 19 is a perspective view of the face shield installation process showing the face shield 49 on the right side installed, and the face shield 49 on the left side being installed.

Figure 20:
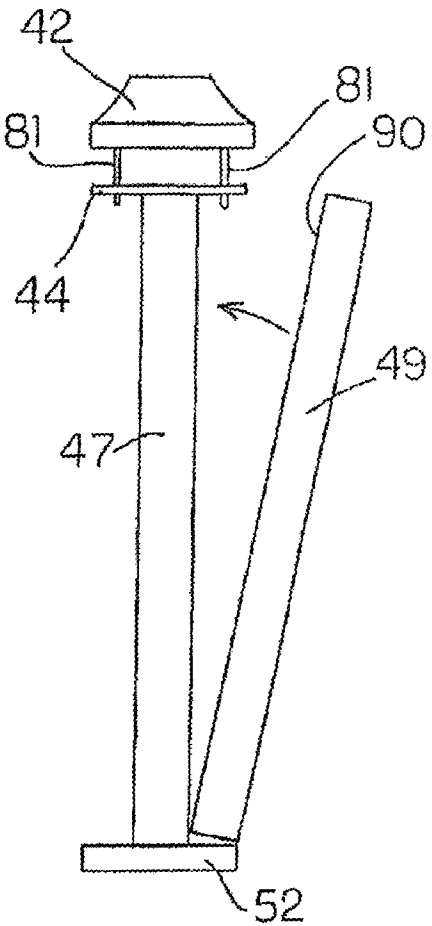
FIG. 20 is a perspective view of a perimeter beam tower showing a face shield installation (right side)

FIG. 20 is a perspective view of the face shield installation process of the face shield 49 on the right side of the figure. This view also shows the solar cap opening mechanism 40 atop the beam housing frame 47.

Figure 21:
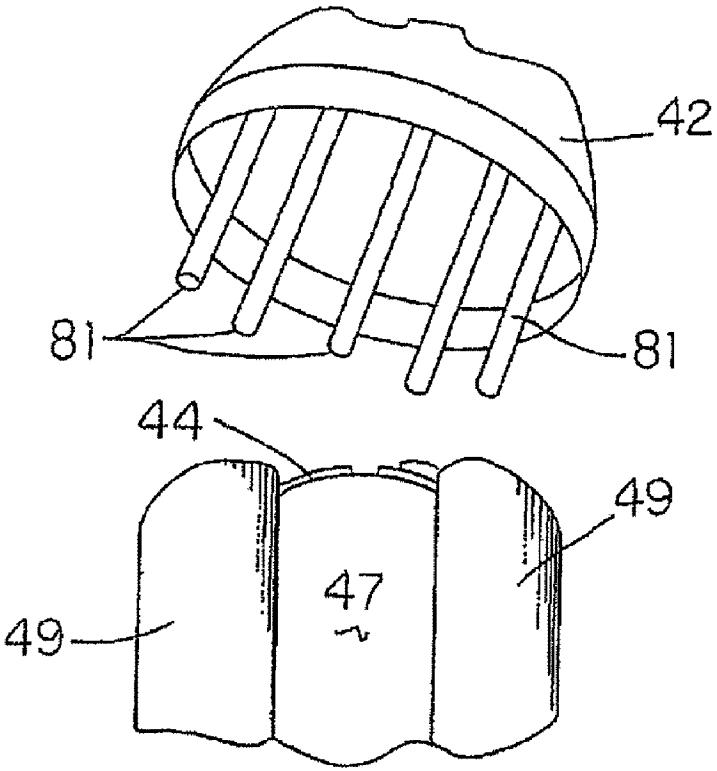
FIG. 21 is a perspective view of the top cap being installed upon the perimeter beam tower.

FIG. 21 is a perspective view of the solar base cap 42 and the swivel bracket O-ring 36 being installed atop the beam housing frame 47. A plurality of alignment pins 81 aid in securing the solar base cap 42 to the top of the beam housing frame 47.

Figure 22:
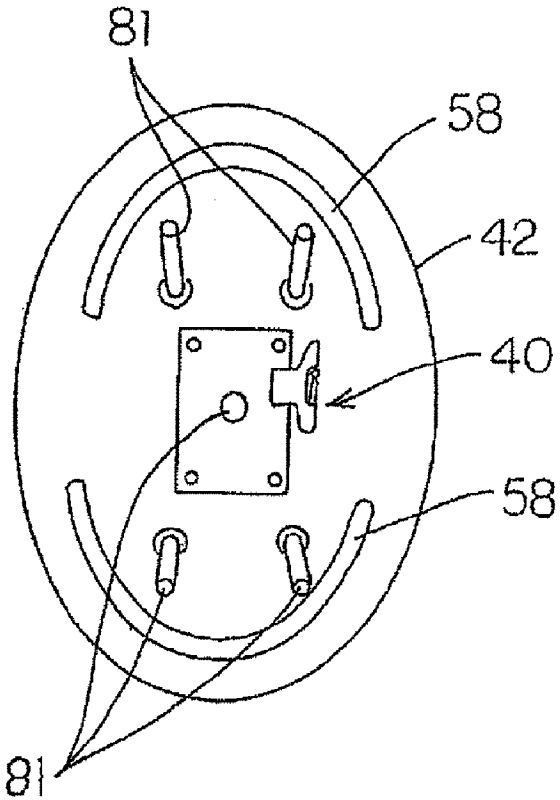
FIG. 22 is a bottom view of a solar cap and mechanism of FIG. 21.

FIG. 22 is a perspective view of the solar cap opening mechanism 40 and the solar base cap 42, as seen from the underside thereof, showing the solar cap opening mechanism 40.

Figure 23:
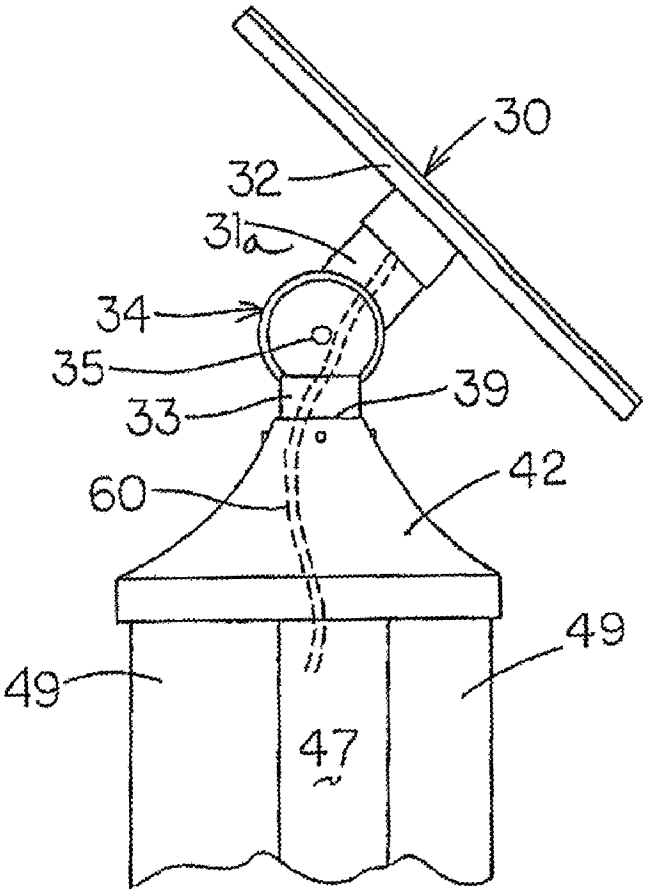
FIG. 23 is a perspective view of a solar cap, swivel bracket, and solar panel mounted upon the solar base cap of the perimeter beam tower.

FIG. 23 is a perspective view of the solar panel 30 and solar mounting bracket 32, with the upper portion 31*a* of the swivel clamp 34 secured to the solar mounting bracket, and the lower portion of the swivel clamp 34 secured to the solar base cap 42. Where a solar panel 30 is not used, the top plate 44 may support a street light 62.

Figure 24:
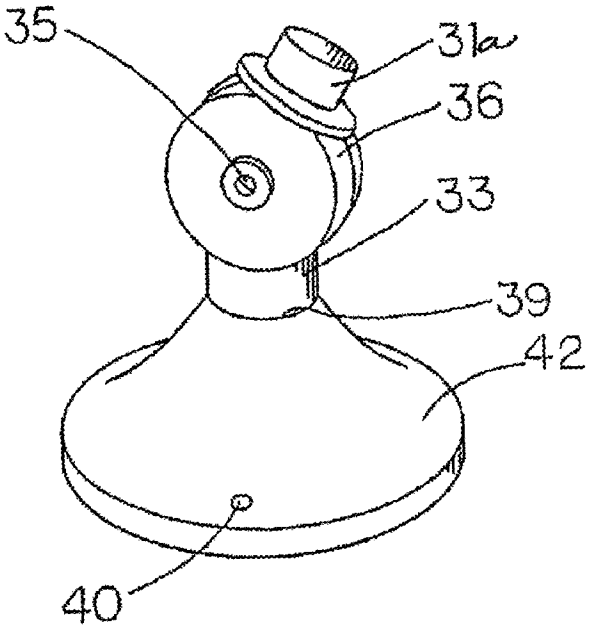
FIG. 24 is a perspective view of a swivel bracket mounted upon the solar base cap of the perimeter beam tower.

FIG. 24 is a perspective view of the swivel clamp 34 adjustably secured together with a fastening means 35. A swivel O-ring 36 is positioned between the upper portion 31*a* and the lower portion 33 of the swivel clamp 34. A solar cap O-ring 38 is positioned between the lower portion 33 of the swivel clamp 34 and the swivel aperture 39 in the solar base cap 42.

Figure 25:
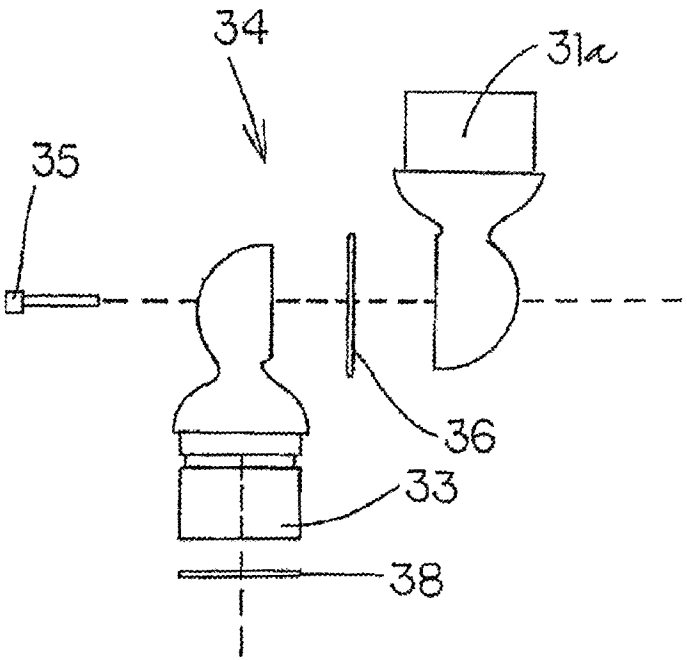
FIG. 25 is a breakaway view of the swivel bracket parts used in FIG. 24.

FIG. 25 is an exploded view of a swivel clamp 34 showing the upper portion 31*a*, the lower portion 33 and the swivel O-ring 36 shown assembled in FIG. 24.

Figure 26:
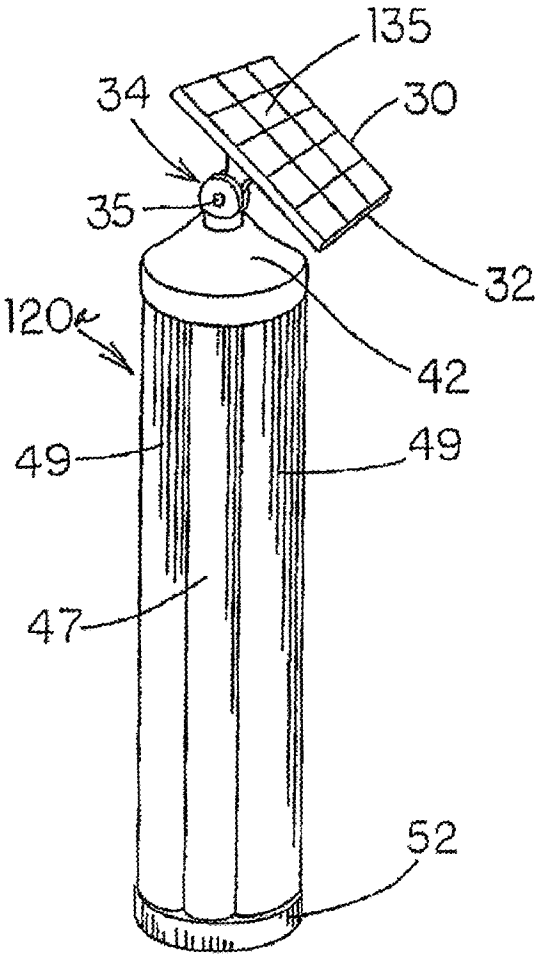
FIG. 26 is a perspective view of a complete perimeter beam tower with a solar panel mounted upon the top plate.

FIG. 26 is a perspective view of the assembled solar tower beam unit 120 with the solar panel 30 installed.

Figure 27C:
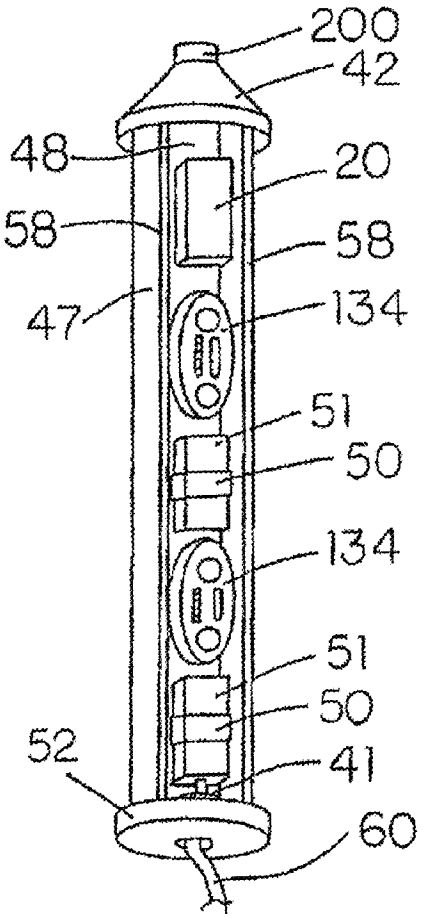
FIGS. 27A, 27B, and 27C are assembled views of a perimeter beam tower.
Figure 27B:
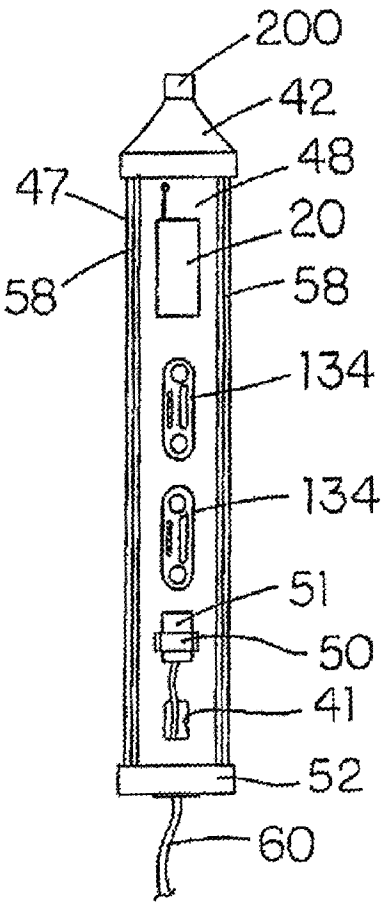
Figure 27A:
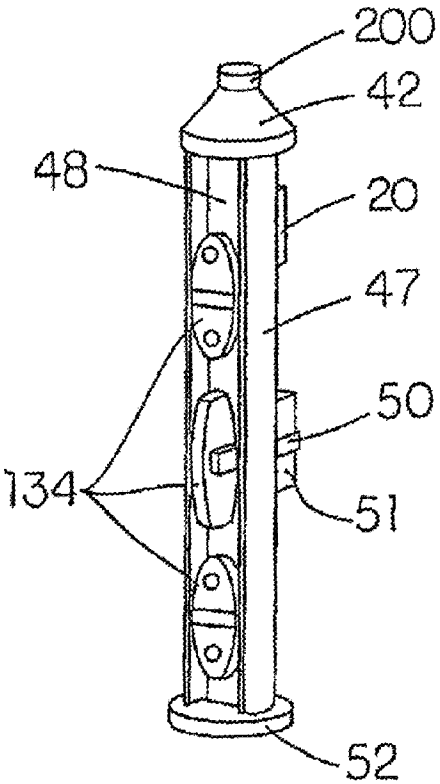

FIG. 27A, FIG. 27B, and FIG. 27C are selective views of various forms of the perimeter beam tower with the face shields 49 removed, showing various electronic equipment mounted upon the frame unit 47; where like reference numerals refer to like features previously described. The forms in FIGS. 27B and 27C include an electrical power cable 60 that may be used in additional or as an alternative to solar panel sourced power.

FIG. 28A is a diagram showing a dual detector beam 56 extending between adjacent perimeter beam towers 120, with an acoustic (microphonic) detection cable 135.

Figure 28B:
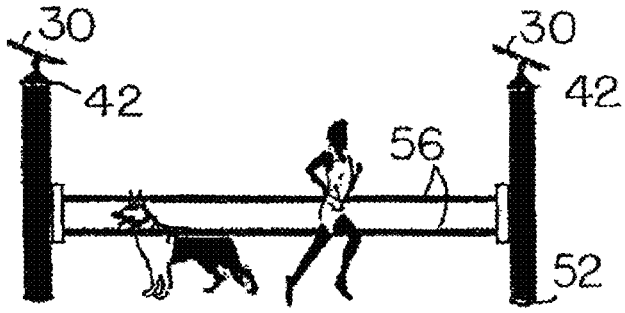
FIG. 28B is a diagram of the perimeter beam tower utilizing a point to point single dual detection beam.

FIG. 28B is a diagram showing a dual detector beam 56 extending between adjacent perimeter beam towers 120.

Figure 28C:
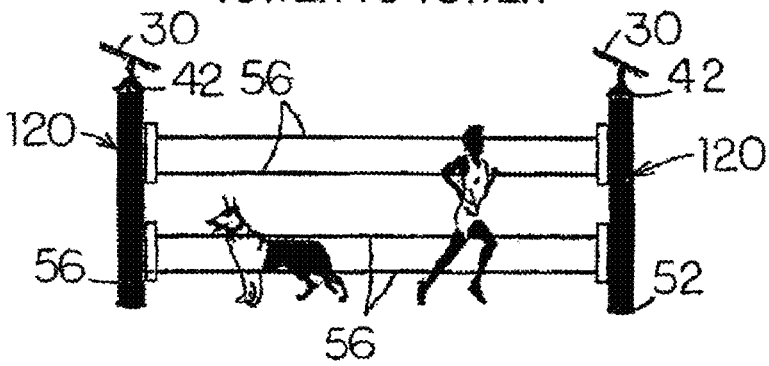
FIG. 28C is a diagram of the perimeter beam tower utilizing high/low point to point quad detection beams.

FIG. 28C is a diagram showing two dual detector beams 56 (collectively quad beams) extending between adjacent perimeter beam towers 120.

Figure 28D:
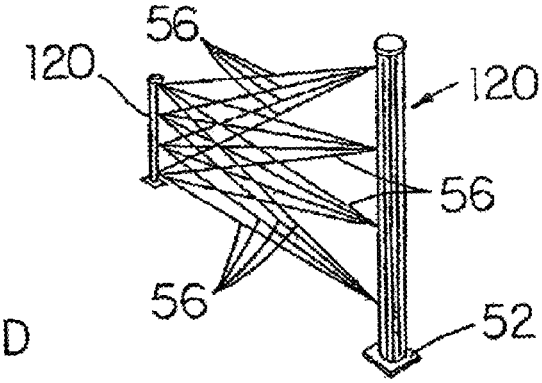
FIG. 28D is a diagram of the perimeter beam tower utilizing multiple detection beams.

FIG. 28D is a diagram showing multiple detector beams 56 extending between adjacent perimeter beam towers 120.

Figure 29:
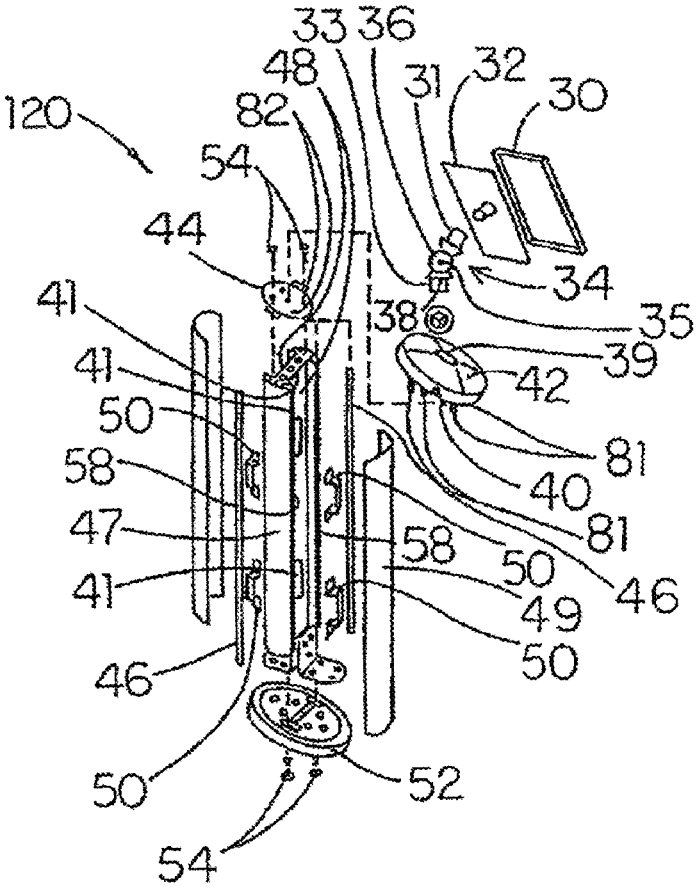
FIG. 29 is a breakaway view of the perimeter beam tower prior to the assembly.

FIG. 29 is a breakaway view of the perimeter beam tower 120, with a solar panel 30.

FIG. 30 is a perspective view of the perimeter beam tower 120 with a solar panel 30 attached, and quad beam arrangement provided by detection equipment 134.

Figure 34:
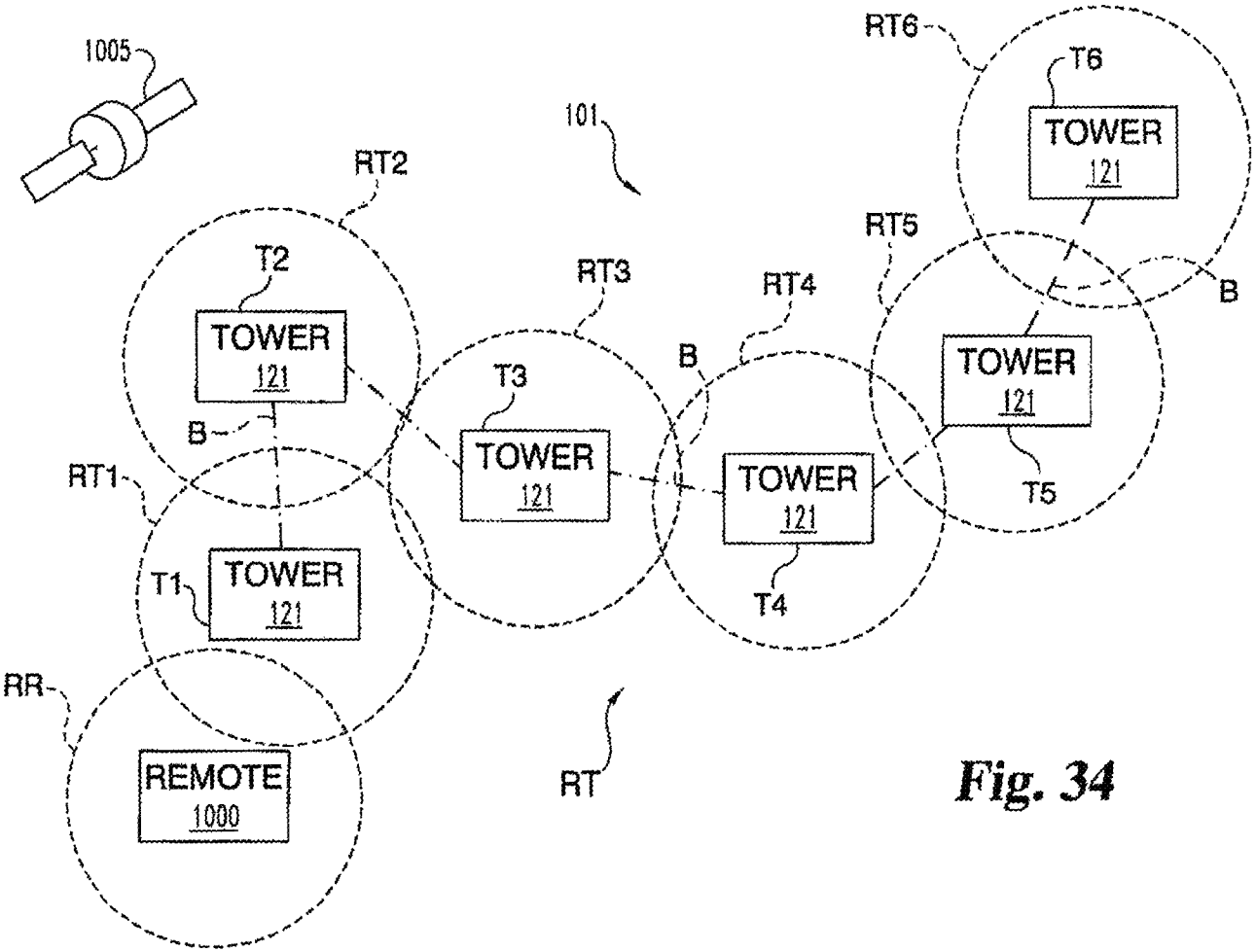
FIG. 34 is a top view of a version of the security system employing a different type of solar towers.

FIG. 34 is a top view illustrating a security system 100' employing solar towers 121 for detecting an intruder; where like reference numerals refer to like features previously described. Towers 121 are configured like towers 120 previously described with further details concerning certain optional modes of communication. The security system 101 includes a remote processing unit 1000 communicating with electronic devices in the solar beam towers 121. Remote unit 1000 is similar to receiver/processor and transmitter unit 20 of system 100. Remote unit 1000 is configured to send and receive signals from solar beam towers 120.

Figure 35:
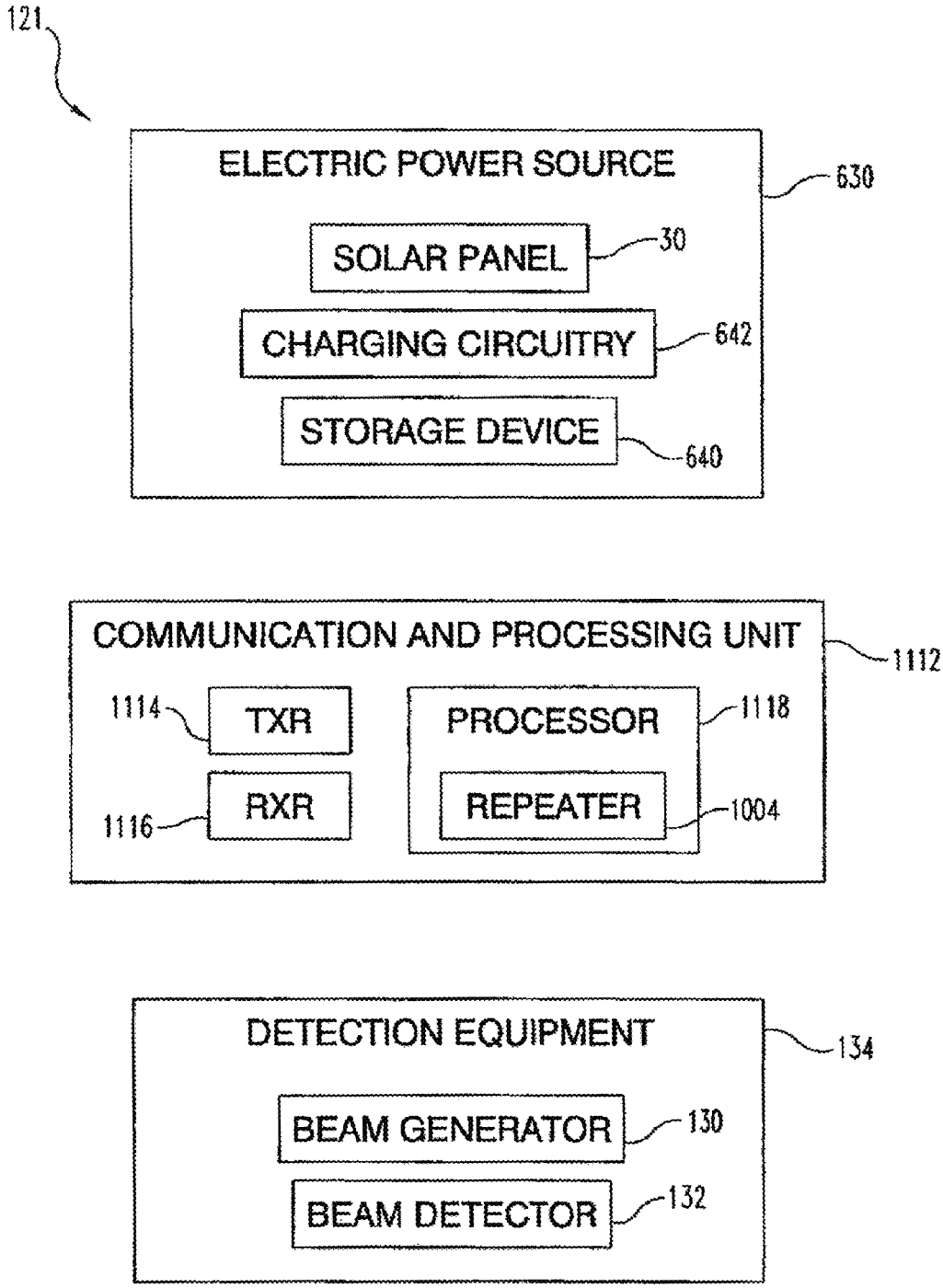
FIG. 35 is a schematic view of a representative tower for the system of FIG. 34.

Referring additionally to FIG. 35, a representative tower 121 is schematically illustrated; where like reference numerals refer to like features previously described. Tower 121 includes electric power source 630 with solar panel 30, charging circuitry 642 and electric energy storage device 640 previously described. Alternatively or additionally, source 630 of each tower 121 can include a different type of electric power source, such as a generator powered by an internal combustion engine, a wind turbine, or hydraulic flow, fuel cell, and/or a connection to a public electric power grid or the like. Tower 121 further includes a wireless communication unit 1112. Communication unit 1112, includes a receiver (RXR) 1114, a transmitter (TXR) 1116, and a processor 1118 to controlled two-way (bidirectional) wireless communications and associated signal processing as previously described in connection with board 600 previously described.

In addition, tower 121 is arranged to optionally operate processor 1118 in concert with RXR 1114 and TXR 1116 to logically define a wireless communication signal repeater as represented by reference numeral 1004. Repeater 1004 detects wireless communication signals with the corresponding RXR 1114 that emanate from other recognized transmitting sources, such as other towers 121, and repeats these signals with the corresponding TXR 1116. These repeated signals can be detected by farther receiving devices of different towers 121 and/or unit 1000. Accordingly, repeater 1004 facilitates relaying a signal from one tower 121 to the next and/or to/from unit 1000 either directly or by way of repeater 1004 of one or more other towers. Such aspects of towers 121 can be desirable when one or more of the towers 121 is out of communication range of unit 1000 and/or one or more other of towers 121.

Tower 121 also includes detection equipment 134 as previously described, including one or more beam generators 130 and one or more beam detectors 132; however, other types of detection equipment previously described can be alternatively or additionally employed. Likewise, tower 121 can optionally include some or all of the other features of the previously described tower 120, such as a remote camera, alarm, indicator, and the like (See FIGS. 6-9, for instance).

Referring back to FIG. 34, remote unit 1000 has a maximum communication range schematically represented by the range circle RR Towers 121 each have a corresponding limited communication range. The illustrated towers 121 and corresponding communication ranges are individually designated as tower T1, T2, T3, T4, T5, and T6 and range RT1, RT2, RT3, RT4, RT5, and RT6; respectively. Tower communication ranges are collectively designated ranges RT. Towers 121 are spaced apart from one another to define a number of connected detection zones/segments along a geographic border B that can be used to monitor border crossing. In other embodiments, a different type of open perimeter can be defined with towers 121 for security monitoring or otherwise, and/or a closed perimeter arrangement can be provided as defined in previous embodiments (FIGS. 1, 11, 31-33, for instance).

As shown in FIG. 34, solar beam towers 120 are all located outside of the maximum communication range RR except for tower T1, which has range RT1 overlapping range RR of unit 1000. As among towers 120, each of communication ranges RT overlaps at least on other of communication ranges RT. More specifically, ranges RT1, RT2, and RT3 each overlap the others; range RT3 also overlaps range RT4, and range RT5 overlaps ranges RT4 and RT6. In other embodiments, more or fewer towers 121 and/or overlapping communication ranges RT could be utilized.

In operation, an intrusion involving the crossing of border B is detected by one or more towers 121, such as tower T6. Because tower T6 is outside of the communication range RR, it cannot directly communicate the intrusion to unit 1000. Instead, repeater 1004 of each tower 120 is used to relay a corresponding signal to unit 1000 through a sequence of towers 120, such as towers T5, T4, T3, and T1 and/or T5, T4, T3, T2 and T1. Intrusion detection by a different tower T2-T5 would likewise be out of range RR, but can be reported by relayed signaling through intervening repeaters 1004. It should be understood that commands from unit 1000 can be relayed to a tower 121 outside of ranged RR by repeater(s) 1004.

Furthermore, in an alternative embodiment it should be appreciated that in lieu of a single communication range overlap between a given pair of towers 121 (such as ranges RT3/RT4, RT4/RT5, and RT5/RT6); in other arrangements towers 121 can be deployed relative to ranges RT to assure that several are each within range of a given tower 121 to reduce the chance of communication disruption from a single point tower failure. The overlap of ranges RT1, RT2, and RT3 provide a representative example of the kind of communication range overlap that could be extended to all other towers 121 in this alternative embodiment.

In still a further alternative, one or more repeaters could be utilized that are not associated with other functions/structures of the tower 121, solar powered or otherwise. In another embodiment, a mixture of different tower types some with and some without repeaters 1004 could be utilized, that also may be arranged with dedicated, "non-tower" repeaters.

In yet another optional communication mode, FIG. 34 illustrates an Earth-orbiting communication satellite 1005 that is in wireless communication with unit 1000 and at least some of towers 121, such as those outside of communication range RR. Satellite 1005 could be used to relay signals between different towers 121 and/or directly between a given tower 121 and unit 1000. Further, satellite relaying of signals could be used in lieu of or in addition to the ground-based repeaters, such as repeaters 1004 of towers 121. While shown in connection with system 101, it should be appreciated that in other embodiments, satellite 1005 and communications otherwise, are absent.

Figure 36:
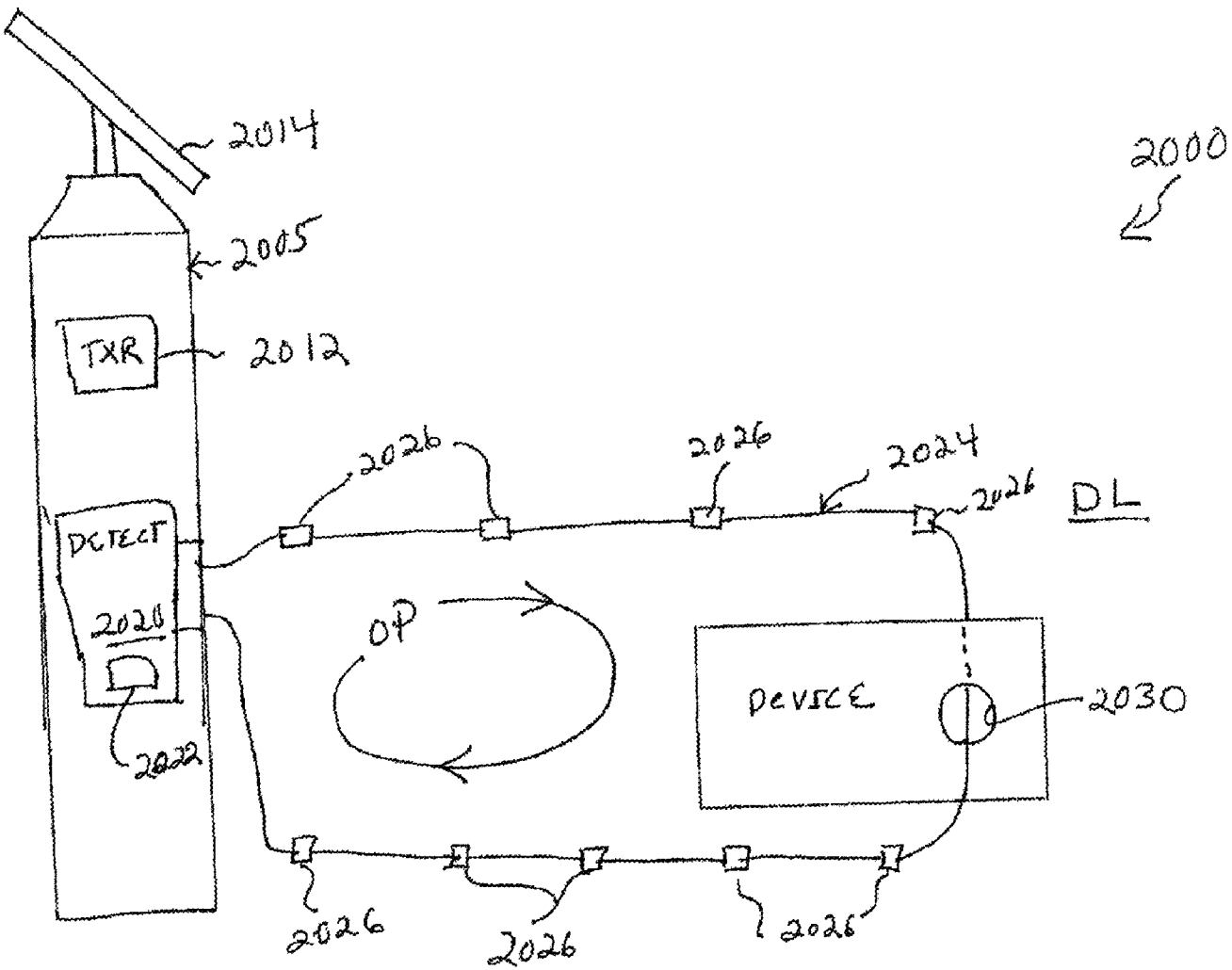
FIG. 36 is a schematic view of a further version of a security system utilizing a break away fiber optic cable detector.

FIG. 36 refers to another embodiment of the present invention in which a monitoring system 2000 includes solar tower 2005 that is used to monitor watercraft, outboard boat engines, and/or other vehicle or mobile device/structure 2010 resting at a designated location DL via a fiber optic detection method. Tower 2005 includes a wireless transmitter 2012 and solar power 2014 along the lines discussed for other towers previously. Tower 2005 also includes a detection arrangement 2020 with a sensor 2022 that can detect whether an a separation along an optical pathway OP has occurred through a correspondingly attached fiber optic cable 2024. Fiber optic cable 2024 is wrapped around and/or placed through one or more apertures 2030 defined by device 2010 and includes a number of serially interconnected fiber optic couplers 2026. These couplers 2026 are easily pulled apart—separated—when trying to remove the device 2010. The cable 2024 is connected at both ends to tower 2000 to define the pathway OP. Accordingly, if there is an attempt to remove the protected/monitored device (boat, engine, jet ski, engine, or the like) from the designated location DL, the movement pulls apart one or more of the couplers 2026 and breaks the optic pathway OP of the corresponding fiber optic cable loop. This breakage is sensed by sensor 2022, which triggers an alarm/intrusion condition and the tower communicates corresponding information with transmitter 2012 to a central station, such as a guard house, harbor master, and/or other destination using previously described techniques. System 2000 may or may not be used with other intruder monitoring techniques previously described and/or may not be solar powered in other embodiments.

This break away fiber optic cable detection approach can be used with movable gateways and other movable structures besides vehicles. Furthermore, in other embodiments multiple towers can be utilized with multiple fiber optic detection cables, and optionally, some or all of the cables may each be connected to more than one tower, with separation detection being correspondingly adapted to this different configuration. In such alternative approaches, pathway closure is provided by wireless communication between towers connected to the same cable and/or the tower are serially connected to provide a closed loop using fiber optic detection cables in place of beams described in connection with FIG. 1, making other adaptations as appropriate.

Many other embodiments of the present application are envisioned. For example, in a further embodiment, a system, comprises: a plurality of spaced apart towers to define an intrusion detection area and a processing unit in wireless communication with at least one of the towers to provide an indication when intrusion is detected with one or more of the towers. The towers each include: a respective beam generator and a respective beam detector, the respective beam detector of a respective one of the towers receiving an intrusion detection beam from the respective beam generator of another of the towers; a respective wireless communication device including a transmitter operable to send signals corresponding to intrusion status; and a respective electric power source including a solar panel and an electrical energy storage device in electrical communication with the solar panel, the respective electric power source being structured to provide electric power to the respective beam generator, the respective beam detector, and the respective wireless communication device.

Another example of a system according to the present application, comprises: a plurality of spaced apart towers to detect intrusion, the towers each including respective detection equipment and a respective tower electric power source including a solar panel and an electrical energy storage device in electrical communication with the solar panel; a first one of the towers including a first tower wireless communication transmitter to transmit signals over a first wireless communication range; a second one of the towers including a second tower wireless communication receiver within the first wireless communication range to receive the signals from the first wireless communication transmitter and a second tower wireless communication transmitter to retransmit the signals from the first wireless communication transmitter over a second wireless communication range; and a processing unit with a processing wireless communication receiver outside the first wireless communication range, the processing unit being responsive to the signals retransmitted by the second tower wireless receiver over the second wireless communication range to indicate when an intrusion is detected with the respective detection equipment of one or more of the towers.

A different example relates to a perimeter security system comprising: a processing unit, and several detection towers spaced from one another and the processing unit. The towers each include: means for detecting an intruder, means for communicating with the processing unit, and means for providing electrical power to the detecting means and the communicating means, the providing means including a solar panel and an electrical energy storage device in electrical communication with the solar panel.

Another example is directed to a method, comprising: operating a number of spaced apart intrusion detection towers, the towers each including detection equipment coupled thereto; providing electric power to operate the detection equipment of each of the towers with a corresponding solar panel; wirelessly transmitting signals from one or more of the towers to a processing unit; and in response to the signals, providing an indication of intrusion status with the processing unit to an operator.

Yet another example includes: a number of spaced apart intrusion detection towers, the towers each including detection equipment coupled thereto; means for providing electric power to operate the detection equipment of each of the towers with a corresponding solar panel; means for wirelessly transmitting signals from one or more of the towers to a processing unit; and means for providing an indication of intrusion status with the processing unit to an operator in response to the signals.

A further example is directed to a method, comprising: operating a number of spaced apart intrusion detection towers, the towers each including a respective solar panel and respective detection equipment; providing electric power to operate the respective detection equipment of each of the towers with the respective solar panel to define an intrusion detection zone with the towers; wirelessly transmitting a signal from one of the towers; and providing the wireless communication signal to a processing unit by relaying the signal between two or more other of the towers, the processing unit being outside of a communication range of the one of the towers and being within a communication range of one or more of the other of the towers.

Yet a further example comprises: a number of spaced apart intrusion detection towers, the towers each including a respective solar panel and respective detection equipment; means for providing electric power to operate the respective detection equipment of each of the towers with the respective solar panel to define an intrusion detection zone with the towers; means for wirelessly transmitting a signal from one of the towers; and means for providing the wireless communication signal to a processing unit by relaying the signal between two or more other of the towers, the processing unit being outside of a communication range of the one of the towers and being within a communication range of one or more of the other of the towers.

Another example includes a system, comprising: a plurality of spaced apart towers each including respective detection equipment to define an intrusion detection zone between each different pair of the towers, a respective tower wireless communication transmitter operable to send signals corresponding to intrusion detection, and a respective tower electric power source including a solar panel and an electrical energy storage device in electrical communication with the solar panel; and a processing unit responsive to the signals from the respective tower wireless communication transmitter of any of the towers to indicate when an intrusion is detected with one or more of the towers, the processing unit including a processing wireless communication receiver structured to receive the signals from the respective wireless tower transmitter of at least one of the towers.

A further example is directed to an apparatus, comprising: a tower to monitor a vehicle or portion thereof while resting at a designated site, the tower including: a detection arrangement including a optic cable engaged with the vehicle and structured to be separated if the vehicle is removed from the designated site; a wireless communication device including a transmitter operable to send signals corresponding to removal status of the vehicle; and a respective electric power source including a solar panel, the respective electric power source being structured to provide electric power to the detection arrangement and the wireless communication device. The vehicle can be a watercraft and the designated site can be a boat dock, the optic cable can extend through an aperture defined by the vehicle, and/or the optic cable can include a number of break away couplers. In still another form, the detection arrangement is applied to a moveable access point structure, such as a door, gateway, or the like.

Yet a further example is a method, comprising: providing a tower to monitor a vehicle or portion thereof while the vehicle is resting at a designated site, the tower including a detection arrangement with an optic cable, a wireless transmitter, and a solar power source; engaging the optic cable with the vehicle; coupling the optic cable to the tower; detecting the optic cable has been separated when the vehicle has been removed from the designated site; and wireless transmitting information from the transmitter to report the detecting. The vehicle can be a watercraft and the designated site can be a boat dock, the optic cable can extend through an aperture defined by the vehicle, and/or the optic cable can include a number of break away couplers. In still another form, the detection arrangement is applied to a moveable access point structure, such as a door, gateway, or the like.

Any theory, mechanism of operation, proof, or finding stated herein is meant to further enhance understanding of the present invention and is not intended to make the present invention in any way dependent upon such theory, mechanism of operation, proof, or finding. It should be understood that while the use of the word preferable, preferably or preferred in the description above indicates that the feature so described may be more desirable, it nonetheless may not be necessary and embodiments lacking the same may be contemplated as within the scope of the invention, that scope being defined by the claims that follow. In reading the claims it is intended that when words such as "a," "an," "at least one," "at least a portion" are used there is no intention to limit the claim to only one item unless specifically stated to the contrary in the claim. Further, when the language "at least a portion" and/or "a portion" is used the item may include a portion and/or the entire item unless specifically stated to the contrary. While the invention has been illustrated and described in detail in the drawings and foregoing description, the same is to be considered as illustrative and not restrictive in character, it being understood that only the selected embodiments have been shown and described and that all changes, modifications and equivalents that come within the spirit of the embodiments defined herein or by any of the following examples are desired to be protected.

What is claimed is:

1. A method, comprising:

operating a number of spaced apart intrusion detection towers, the towers each including a respective solar panel and respective detection equipment;

providing electric power to operate the respective detection equipment of each of the towers with the respective solar panel to define an intrusion detection zone with the towers;

wirelessly transmitting a signal from one of the towers; and wirelessly providing the signal to a processing unit by relaying the signal between two or more other of the towers, the processing unit being outside of a communication range of the one of the towers and being within a communication range of one or more of the other of the towers.

2. The method of claim 1, which includes:

generating a beam with the respective detection equipment of a first one of the towers; and directing the beam to the respective detection equipment of a second one of the towers.

3. The method of claim 2, which includes detecting an interruption in the beam with the respective detection equipment of the second one of the towers.

4. The method of claim 1, wherein the detection equipment includes an acoustic detection cable.

5. A system, comprising: a plurality of spaced apart towers to define an intrusion detection area and a processing unit in wireless communication with at least one of the towers to provide an indication when intrusion is detected with one or more of the towers, the towers each including:

a respective beam generator and a respective beam detector, the respective beam detector of a respective one of the towers receiving an intrusion detection beam from the respective beam generator of another of the towers;

a respective wireless communication device including a transmitter operable to send signals corresponding to intrusion status and a receiver operable to receive a command signal from the processing unit; and a respective electric power source including a solar panel and an electrical energy storage device in electrical communication with the solar panel, the respective electric power source being structured to provide electric power to the respective beam generator, the respective beam detector, and the respective wireless communication device;

wherein a first one of the towers has a first communication range, a second one of the towers has a second communication range, and the processing unit includes a wireless communication receiver within the second communication range and outside the first communication range; and wherein the respective wireless communication device of at least a several of the towers includes means for relaying the signals between two or more other of the towers.

6. The system of claim 5, wherein the relaying means includes the respective receiver structured as a signal repeater to relay the signals.

7. The system of claim 5, wherein the intrusion detection beam comprises at least one of an electromagnetic radiation beam and an acoustic beam.

8. The system of claim 7, wherein the electromagnetic radiation beam is at least one of a photoelectric beam, an infrared beam, a laser beam, a microwave beam, and a visible light beam.

9. The system of claim 5, wherein each of the towers further includes a respective camera and the processing unit includes a display structured to provide the indication when intrusion is detected.

10. The system of claim 5, further comprising a satellite structured to relay the signals from the towers to the processing unit.

11. A method, comprising:

operating a number of spaced apart intrusion detection towers and a processing unit, the towers each including detection equipment and wireless communication equipment coupled thereto;

providing electric power to operate the detection equipment and wireless communication equipment of each of the towers with a corresponding solar panel;

wirelessly receiving a signal from the processing unit with the wireless communication equipment of one or more of the towers;

detecting intrusion with the detection equipment of a respective one of the towers;

communicating the detecting of the intrusion to the wireless communication equipment from the detection equipment of the respective one of the towers;

in response to the communicating from the detection equipment of the respective one of the towers, wirelessly transmitting one or more signals to the processing unit; and in response to the one or more signals, providing an indication of intrusion detection with the processing unit to an operator;

wherein the wirelessly transmitting of the signals includes relaying the signals from one tower to another.

12. The method of claim 11, wherein the detection equipment includes a beam generator operable to generate an electromagnetic beam and a beam detector.

13. The method of claim 12, which includes directing the beam from the beam generator of one of the towers to the beam detector of another of the towers.

14. The method of claim 11, wherein the detection equipment includes an acoustic detection cable.

15. A system, comprising: a plurality of spaced apart towers to define an intrusion detection area and a processing unit in wireless communication with at least one of the towers to provide an indication when intrusion is detected with one or more of the towers, the towers each including:

a respective beam generator and a respective beam detector, the respective beam detector of a respective one of the towers receiving an intrusion detection beam from the respective beam generator of another of the towers;

a respective wireless communication device including a transmitter operable to send signals corresponding to intrusion status and a receiver operable to receive a command signal from the processing unit, the command signal including at least one of a request to verify electrical energy storage status, activate a remote camera, activate a microphone module, and activate a speaker module; and a respective electric power source including a solar panel and an electrical energy storage device in electrical communication with the solar panel, the respective electric power source being structured to provide electric power to the respective beam generator, the respective beam detector, and the respective wireless communication device;

wherein a first one of the towers has a first communication range, a second one of the towers has a second communication range, and the processing unit includes a wireless communication receiver within the second communication range and outside the first communication range.

16. The system of claim 15, wherein the respective wireless communication device of at least a several of the towers includes means for relaying the signals between two or more other of the towers.

17. The system of claim 16, wherein the relaying means includes the respective receiver structured as a signal repeater to relay the signals.

18. The system of claim 15, wherein the intrusion detection beam comprises at least one of an electromagnetic radiation beam and an acoustic beam.

19. The system of claim 18, wherein the electromagnetic radiation beam is at least one of a photoelectric beam, an infrared beam, a laser beam, a microwave beam, and a visible light beam.

20. The system of claim 15, wherein each of the towers further includes a respective camera and the processing unit includes a display structured to provide the indication when intrusion is detected.

21. The system of claim 15, further comprising a satellite structured to relay the signals from the towers to the processing unit.

* * * * *